US006399289B1

(12) United States Patent
Hosokawa et al.

(10) Patent No.: US 6,399,289 B1
(45) Date of Patent: Jun. 4, 2002

(54) SILVER HALIDE COLOR PHOTOGRAPHIC LIGHT-SENSITIVE MATERIAL

(75) Inventors: Junichiro Hosokawa; Hisashi Mikoshiba; Yasuhiro Kato, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/671,205

(22) Filed: Sep. 28, 2000

(30) Foreign Application Priority Data

Sep. 28, 1999 (JP) ..... 11-274802

(51) Int. Cl.[7] ..... G03C 1/46

(52) U.S. Cl. ..... 430/505; 430/506; 430/502; 430/503; 430/546; 430/551; 430/631

(58) Field of Search ..... 430/502, 503, 430/505, 506, 546, 631, 551

(56) References Cited

U.S. PATENT DOCUMENTS 4,840,878 A * 6/1989 Hirose et al. ..... 430/546
4,900,655 A * 2/1990 Nakazyo et al. ..... 430/546
5,043,255 A * 8/1991 Junkers et al. ..... 430/546
5,082,764 A * 1/1992 Takahashi ..... 430/546
5,200,304 A * 4/1993 Yoneyama et al. ..... 430/546
5,264,332 A * 11/1993 Otani et al. ..... 430/551
5,731,137 A * 3/1998 Saito et al. ..... 430/546

* cited by examiner

*Primary Examiner*—Geraldine Letscher
(74) *Attorney, Agent, or Firm*—Birch, Stewart, Kolasch & Birch, LLP

(57) ABSTRACT

Disclosed is a silver halide color photographic light-sensitive material comprising, on a support, a unit blue-sensitive layer including at least one blue-sensitive silver halide emulsion layer containing a yellow coupler, a unit green-sensitive layer including at least one green-sensitive silver halide emulsion layer containing a magenta coupler, and a unit red-sensitive layer including at least one red-sensitive silver halide emulsion layer containing a cyan coupler, at least one of the unit blue-, green-, and red-sensitive layers comprising not less than two color-sensitive layers differing in sensitivity, of which a highest-sensitivity layer being positioned farthest from the support, wherein the light-sensitive material has at least one layer containing a high-boiling organic solvent, at least 50% by weight of which is occupied by a high-boiling organic solvent having a viscosity of not less than 300 mPas at 25° C.

5 Claims, No Drawings

SILVER HALIDE COLOR PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 11-274802, filed Sep. 28, 1999, the entire contents of which are incorporated herein by reference.

BACKGROUND OF THE INVENTION

The present invention relates to a silver halide color photographic light-sensitive material and, more particularly, to a light-sensitive material having high resistance to pressure.

Generally, various pressures are applied to a photographic light-sensitive material coated with silver halide emulsions. For example, a general photographic negative film is bent when taken up into a magazine or loaded into a camera, or pulled when advanced. A sheet-like film such as a light-sensitive material for printing or a medical roentgen light-sensitive material is often broken or bent because it is directly handled by human hands. Also, all light-sensitive materials receive high pressure when cut or processed. It is known that when any of various pressures is thus applied to a photographic light-sensitive material, the pressure acts on the material via gelatin as a binder of silver halide grains, and this changes the photographic properties of the material.

Recently, silver halide color photographic light-sensitive materials are being increasingly demanded to have high image quality and high toughness at the same time. If the surface sensitivity of a silver halide is raised to improve the sensitivity and graininess, pressure marks increase in size as a side effect. Jpn. Pat. Appln. KOKAI Publication No. (hereinafter referred to as JP-A-)63-220228 and JP-A-11-15115 have disclosed methods of improving silver halide emulsions as countermeasures. As a measure in layer design, reducing the density of silver halide grains by increasing the binder coating amount is known to be effective. However, the effect is unsatisfactory. Increasing the gelatin coating amount leads to an increase in the film thickness, and side effects such as deterioration of the sharpness and desilvering characteristics are large.

In particular, miniaturization of cameras is recently vigorously studied in addition to down-sizing of formats of film cartridges. Consequently, light-sensitive materials are left to stand for long time periods in cameras while they are bent at high curvatures. The aforementioned methods of improving changes in photographic properties caused by conventionally known instantaneously applied pressures have almost no effects on pressure marks produced by such uses.

Also, requirements for the storage stability of light-sensitive materials are becoming more and more strict in recent years. In particular, color negative films that are used in photography or stored in various environments and conditions are required to have higher stability.

Especially in recent years, amateur divers have many chances to take underwater pictures, so stability at very high humidity is being required in addition to normal storage stability.

BRIEF SUMMARY OF THE INVENTION

It is an object of the present invention to provide a silver halide color photographic light-sensitive material having high resistance to pressure and, more particularly, to provide a light-sensitive material having high resistance to pressure continuously applied for long time periods, which is particularly a problem when the material is loaded into a small-sized camera, and also having high storage stability.

The above object of the present invention is achieved by a silver halide color photographic light-sensitive material having the following arrangements.

(1) A silver halide color photographic light-sensitive material comprising, on a support, a unit blue-sensitive layer including at least one blue-sensitive silver halide emulsion layer containing a yellow coupler, a unit green-sensitive layer including at least one green-sensitive silver halide emulsion layer containing a magenta coupler, and a unit red-sensitive layer including at least one red-sensitive silver halide emulsion layer containing a cyan coupler, at least one of the unit blue-, green-, and red-sensitive layers comprising not less than two color-sensitive layers differing in sensitivity, of which a highest-sensitivity layer being positioned farthest from the support, wherein the light-sensitive material has at least one layer containing a high-boiling organic solvent, at least 50% by weight of which is occupied by a high-boiling organic solvent having a viscosity of 300 mPas or more at 25° C.

(2) The silver halide color photographic light-sensitive material described in item (1) above, wherein the high-boiling organic solvent having a viscosity of 300 mPas or more at 25° C. has a dielectric constant of 7 or more, a log P of 6.5 or more, and a weight-average molecular weight of 500 or more.

(3) The silver halide color photographic light-sensitive material described in item (1) above, wherein at least one of the unit color-sensitive layers comprises three layers arranged adjacent to each other in the order of a highest-sensitivity layer (Lo), a medium-sensitivity layer (Lm), and a lowest-sensitivity layer (Lu) from the farthest side from the support, and an oil phase viscosity ($v_1$) of Lo, an oil phase viscosity ($v_2$) of Lm, and an oil phase viscosity ($v_3$) of Lu, at 50° C., have the following relationship:

$$v_2>1.5v_1$$

or $$v_3>1.5v_1$$

(4) The silver halide color photographic light-sensitive material described in item (2) above, wherein at least one of the unit color-sensitive layers comprises three layers arranged adjacent to each other in the order of a highest-sensitivity layer (Lo), a medium-sensitivity layer (Lm), and a lowest-sensitivity layer (Lu) from the farthest side from the support, and an oil phase viscosity ($v_1$) of Lo, an oil phase viscosity ($v_2$) of Lm, and an oil phase viscosity ($v_3$) of Lu, at 50° C., have the following relationship:

$$v_2>1.5v_1$$

or $$v_3>1.5v_1$$

(5) The silver halide color photographic light-sensitive material described in item (3) above, wherein a plastic deformation ratio ($\alpha_1$) of Lo, a plastic deformation ratio ($\alpha_2$) of Lm, and a plastic deformation ratio ($\alpha_3$) of Lu have the following relationship:

$$\alpha_2<0.95\alpha_1$$

or $$\alpha_3<0.95\alpha_1$$

(6) The silver halide color photographic light-sensitive material described in item (4) above, wherein a plastic deformation ratio ($\alpha_1$) of Lo, a plastic deformation ratio ($\alpha_2$) of Lm, and a plastic deformation ratio ($\alpha_3$) of Lu have the following relationship:

$$\alpha_2<0.95\alpha_1$$

or $$\alpha_3<0.95\alpha_1$$

In the present invention, a silver halide color photographic light-sensitive material having high resistance to pressure and high storage stability can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

In the present invention, the plastic deformation ratio of a color-sensitive layer is defined as follows.

A coating film was formed on a support to have a dried film thickness of 10 $\mu$m and peeled from the support. This film was cut into a 1 cm×5 cm rectangle, one short edge of the rectangle was fixed, and a load of 50 g was applied on the other short edge. The specimen was left to stand for 16 hr in this state at 25° C. and a relative humidity (to be also referred to as RH hereinafter) of 55%, and the creep strain was detected. Letting $L_o$ be the initial length of the specimen and L be the specimen length after creeping, the plastic deformation ratio in the present invention is defined by plastic deformation ratio=$(L-L_o)/L_o$. In the present invention, the oil phase viscosity of a color-sensitive layer was measured by the following method.

Components contained in an oil phase of a specific layer, high-boiling organic solvents, couplers, and other oil-soluble components were thermally dissolved. The viscosity of this oily matter was measured at 50° C. by an E-type viscometer (VISCONIC ED model) manufactured by TOKYO KEIKI K.K., to which a temperature controller was connected.

The viscosity of a high-boiling organic solvent was measured at 25° C. by using the same device. The dielectric constant was measured using a 10-kHz transformer bridge method. The meter used was the TRS-10T manufactured by ANDO ELECTRIC CO., LTD. A log P (P is a partition coefficient when a dissolved substance attains equilibrium between n-octanol and water) indicating the relative water-solubility was calculated using the Mac. log P ver. 2.0.3 computer algorithm. The larger the log P in a minus direction, the more water-soluble the substance.

The present invention relates to a silver halide color photographic light-sensitive material comprising, on a support, a unit blue-sensitive layer including at least one blue-sensitive silver halide emulsion layer containing a yellow coupler, a unit green-sensitive layer including at least one green-sensitive silver halide emulsion layer containing a magenta coupler, and a unit red-sensitive layer including at least one red-sensitive silver halide emulsion layer containing a cyan coupler, at least one of the unit blue-, green-, and red-sensitive layers comprises not less than two color-sensitive layers differing in sensitivity, and a highest-sensitivity layer of the color-sensitive layers is positioned farthest from the support.

At least one layer constituting the light-sensitive material of the present invention contains a high-boiling organic solvent having a viscosity of 300 mPas or more at 25° C. in order to improve the resistance to pressure. This high-viscosity, high-boiling organic solvent of the present invention preferably has a high dielectric constant, high log P, and high molecular weight to improve the color generation properties of couplers and suppress diffusibility at high humidity. From the point of view of the color generation properties and hue, the dielectric constant is preferably 7 to 10, and more preferably, 7.3 to 8.0. The log P is preferably 6.5 to 9.0, and more preferably, 6.7 to 8.0. The weight-average molecular weight is preferably 500 to 3,000, and more preferably, 500 to 1,500 in order to achieve low diffusibility and appropriate flowability for color generation at the same time.

A layer to which the high-viscosity, high-boiling organic solvent of the present invention is added is not particularly limited, so the solvent can be used in any photographic constituent layer. However, this high-viscosity, high-boiling organic solvent of the present invention is used in preferably a sensitive emulsion layer, and more preferably, a green-sensitive emulsion layer. Although the solvent can be used in any of low-, medium-, and high-speed layers, it is used in preferably a low- or medium-speed layer, and more preferably, both low- and medium-speed layers.

The addition amount is also not particularly restricted, but it is preferably 0.01 to 3.0 g/m$^2$, and more preferably, 0.1 to 2.0 g/m$^2$.

In the present invention, the content of the high-boiling organic solvent having a viscosity of 300 mPas or more is 50 wt % or more, preferably 70 wt % or more, and more preferably, 100 wt % or more of the total high-boiling organic solvent amount in at least one layer.

Examples of the high-boiling organic solvent with a viscosity of 300 mPas or more at 25° C. used in the present invention are compounds KHB-1 to KHB-27 presented below. The log P and dielectric constant of any of these compounds were 6.5 to 9 and 7 to 10, respectively.

KHB-1

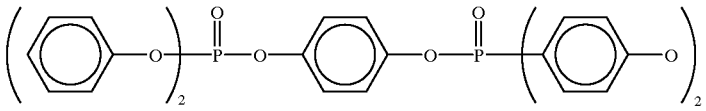

-continued
KHB-2
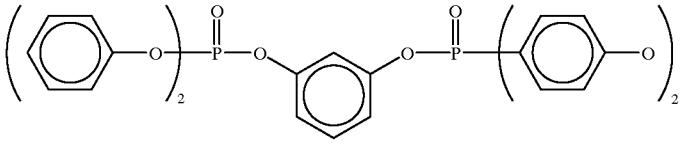
KHB-3
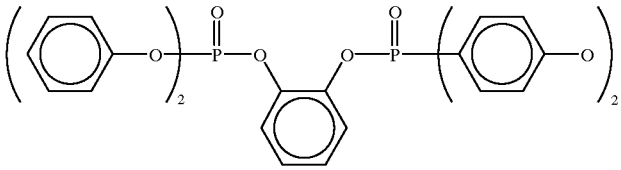
KHB-4
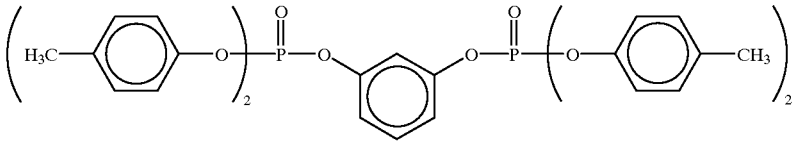
KHB-5
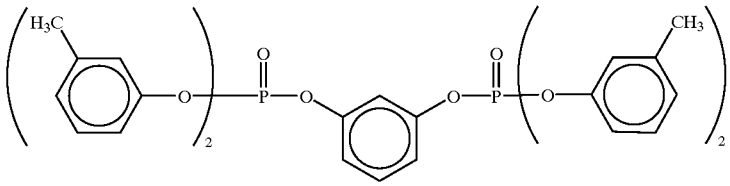
KHB-6
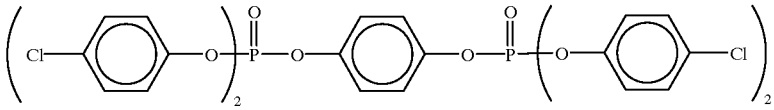
KHB-7
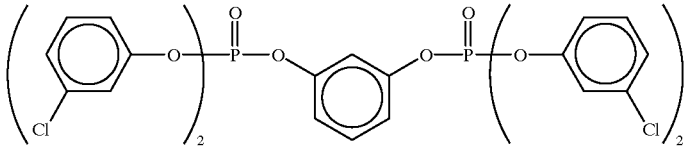

-continued

KHB-8

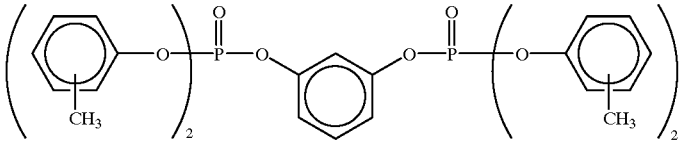

A mixture in which the substitution positions of a methyl group are the m- and p-positions with respect to an oxygen atom

KHB-9

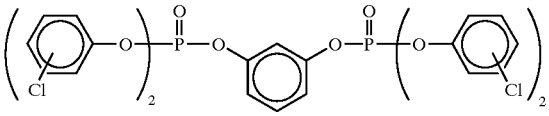

A mixture in which the substitution positions of a chlorine atom are the o-, m-, and p-positions with respect to an oxygen atom

KHB-10

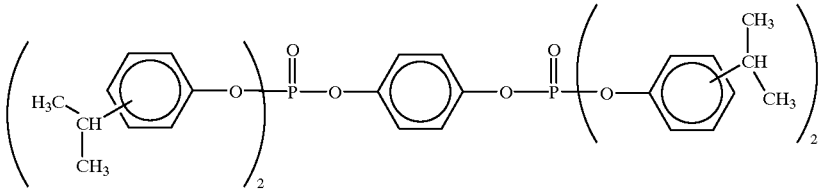

A mixture in which the substitution positions of an isopropyl group are the o-, m-, and p-positions with respect to an oxygen atom

KHB-11

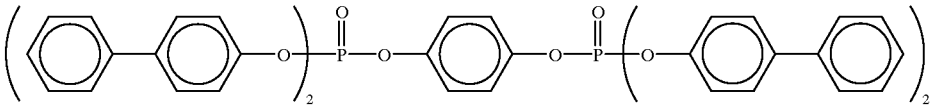

KHB-12

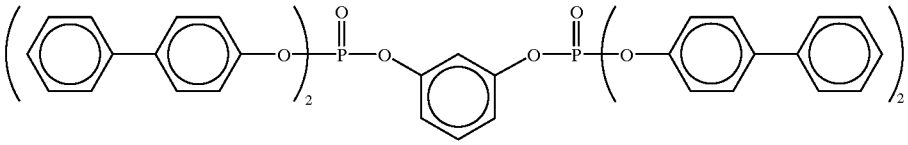

KHB-13

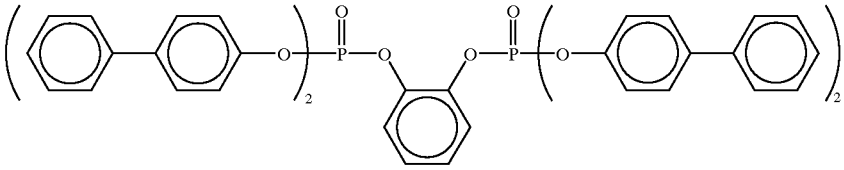

-continued
KHB-14
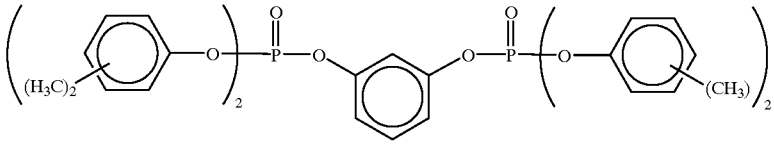
A mixture in which the substitution positions of a methyl group are the o-, m-, and p-positions with respect to an oxygen atom
KHB-15
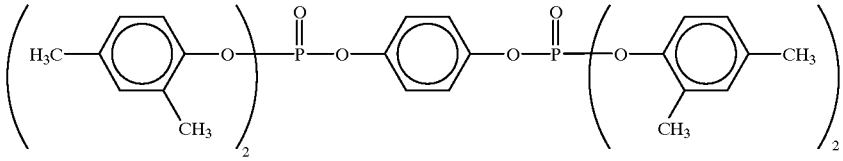
KHB-16
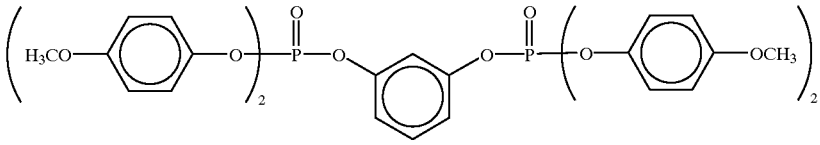
KHB-17
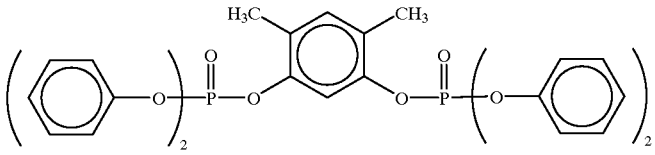
KHB-18
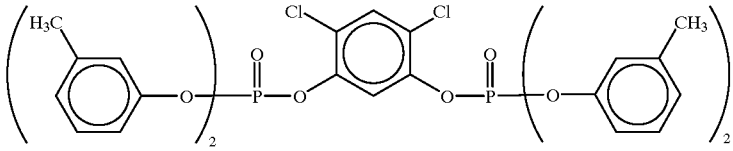
KHB-19
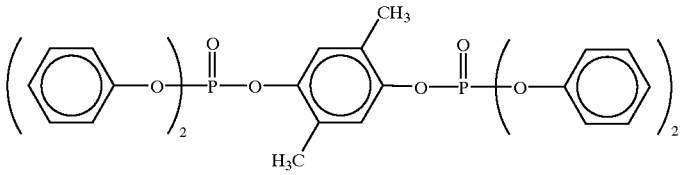
KHB-20
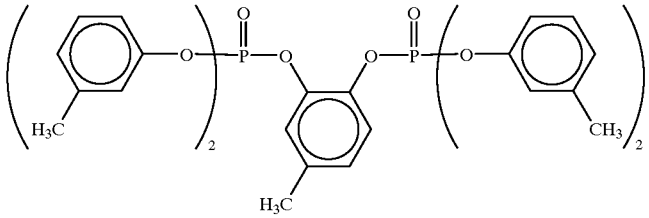

-continued

KHB-21

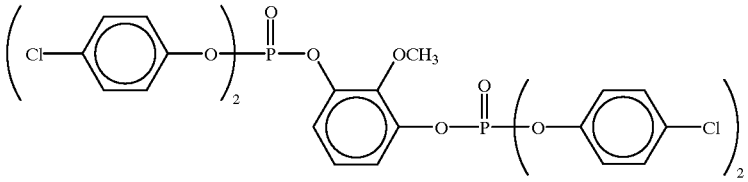

KHB-22

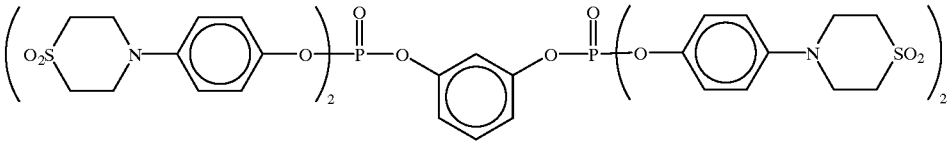

KHB-23

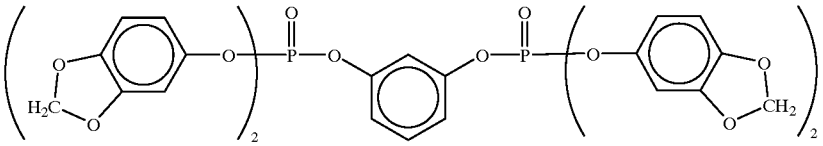

KHB-24

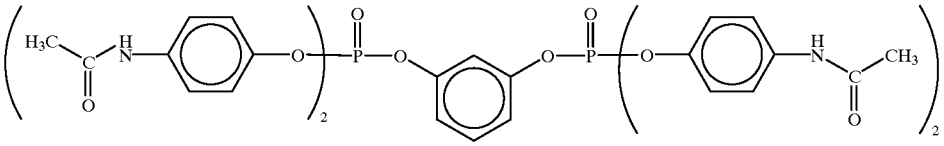

KHB-25

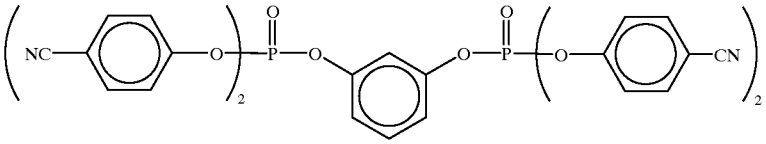

KHB-26

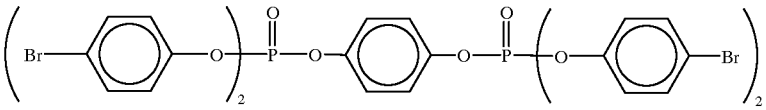

KHB-27

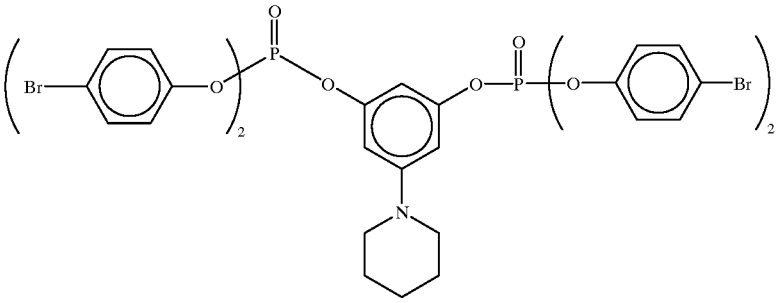

In the present invention, common high-boiling organic solvents used in silver halide photographic light-sensitive materials can be used as dispersion media that can be mixed with the high-boiling organic solvent having a viscosity of 300 mPas or more.

Examples of the high-boiling organic solvent are aryl phosphate-based, alkyl phosphate-based, phthalate-based, benzoate-based, lactate-based, citrate-based, fatty ester-based, carbonamide-based, sulfonamide-based, ether-based, alcohol-based, phenol-based, carboxylic acid-based, paraffin-based, and paraffin halide-based high-boiling organic solvents.
Practical examples are compounds 1 to 132 below.
1.
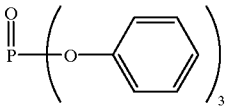
2.
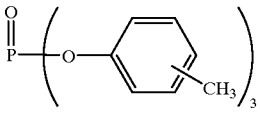
3.
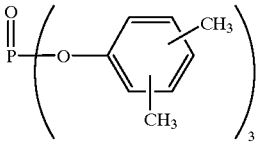
4.
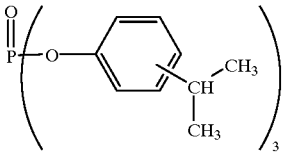
5.
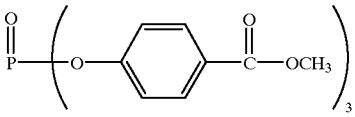
6.
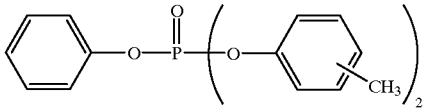
7.
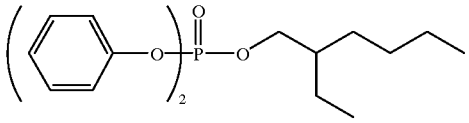
8.
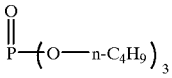
9.
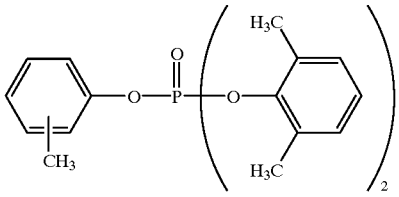
10.
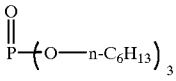
-continued
11.
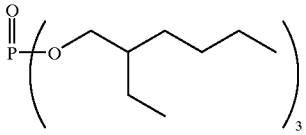
12.
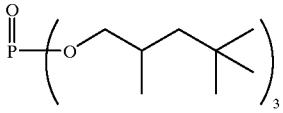
13.
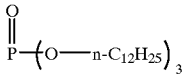
14.
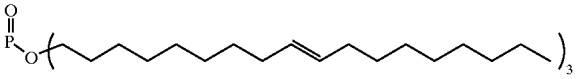
15.
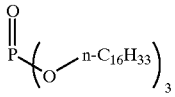
16.
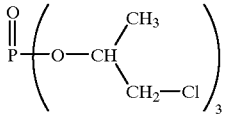
17.
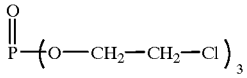
18.
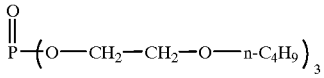
19.
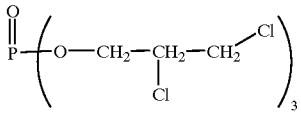
20.
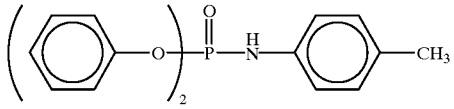
21.
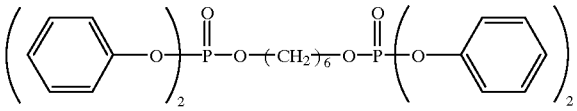
22.
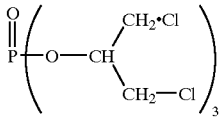

-continued
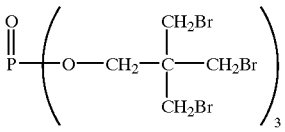
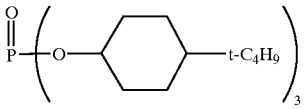
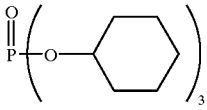
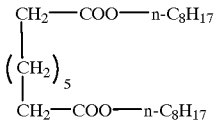
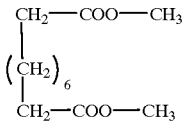
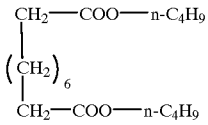
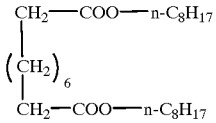
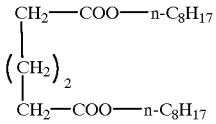
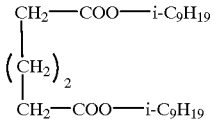
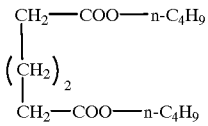
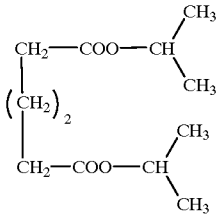
-continued
23.
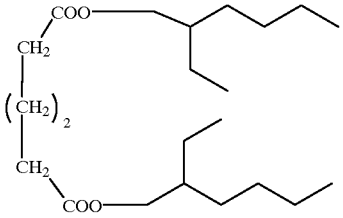
24.
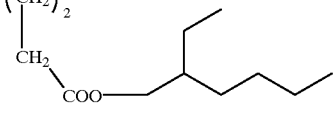
25.
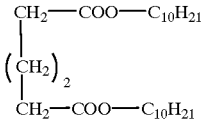
26.
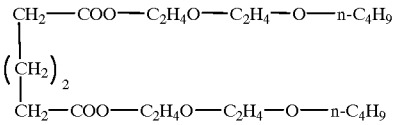
27.
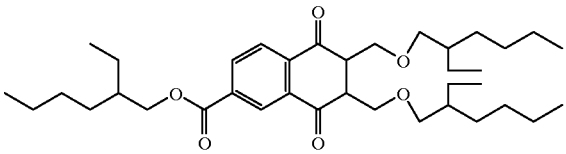
28.
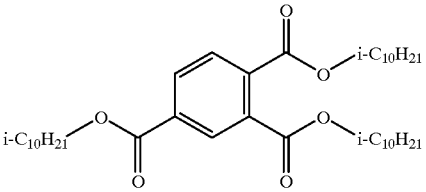
29.
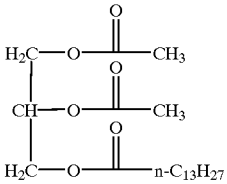
30.
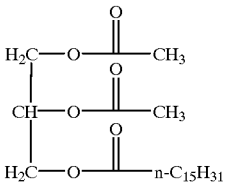
31.
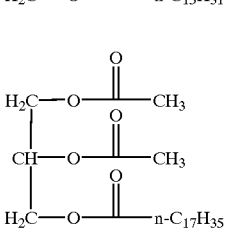
32.
33.
34.
35.
36.
37.
38.
39.
40.
41.

-continued
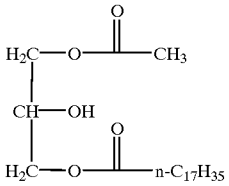
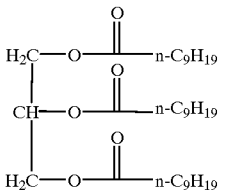
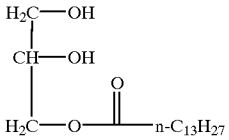
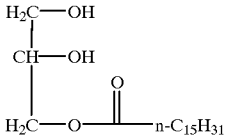
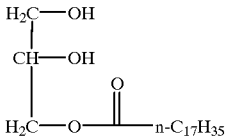
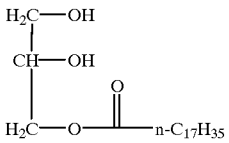
(oleyl)
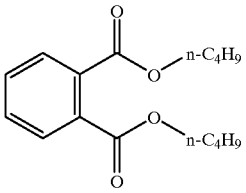
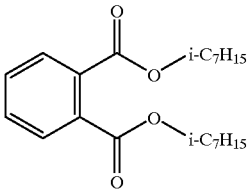
-continued
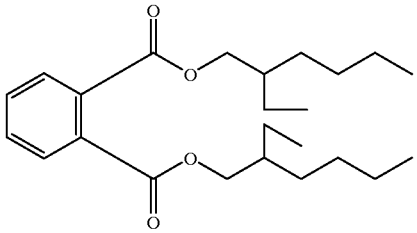
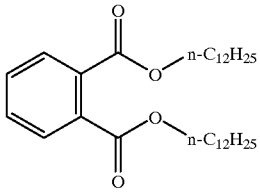
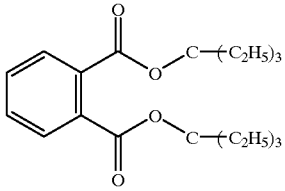
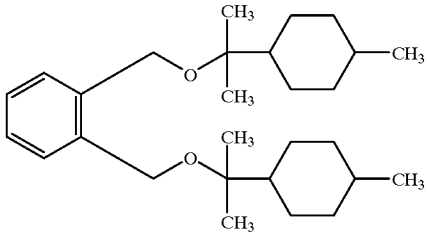
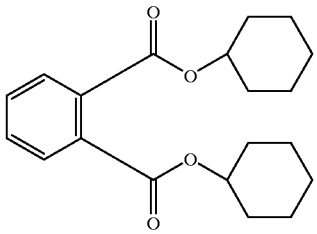
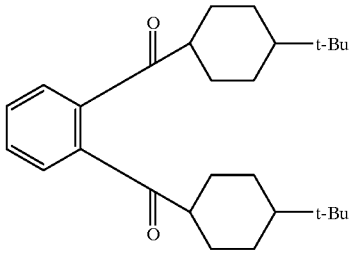
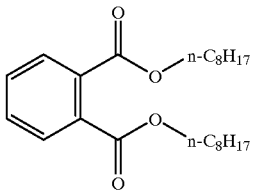

-continued
57.
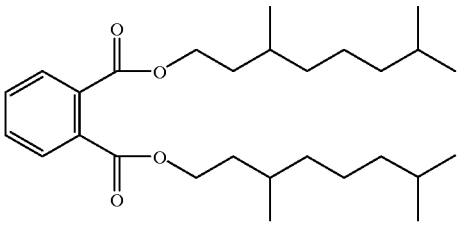
58.
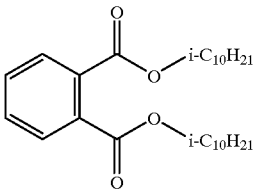
59.
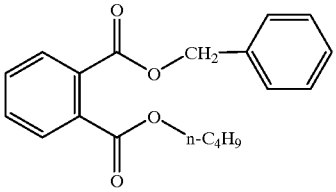
60.
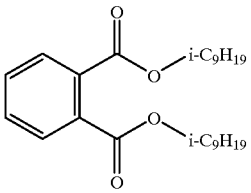
61.
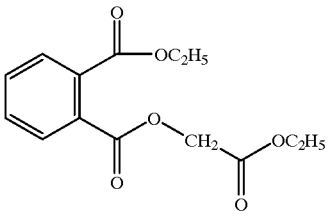
62.
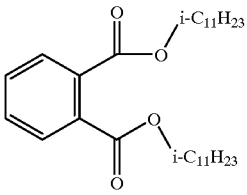
63.
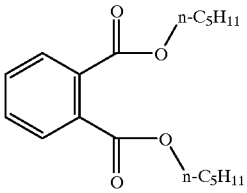
-continued
64.
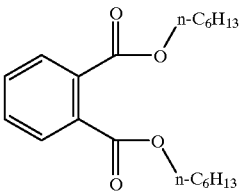
65.
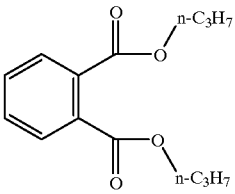
66.
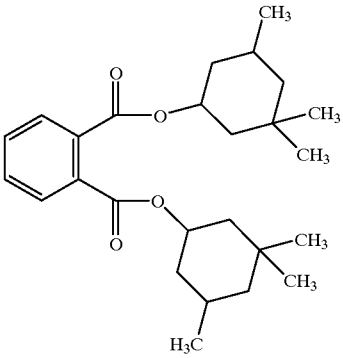
67.
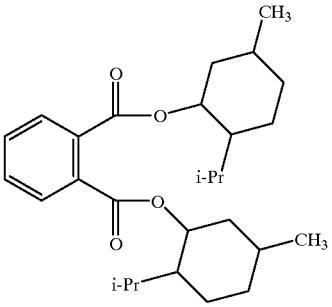
68.
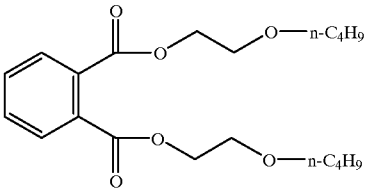
69.
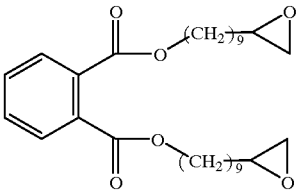

-continued
70.
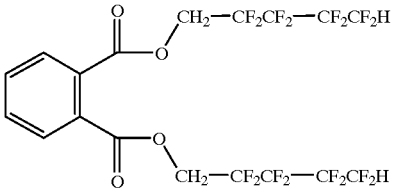
71.
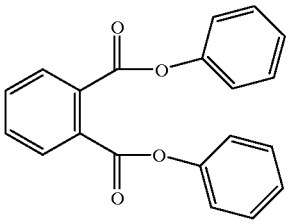
72.
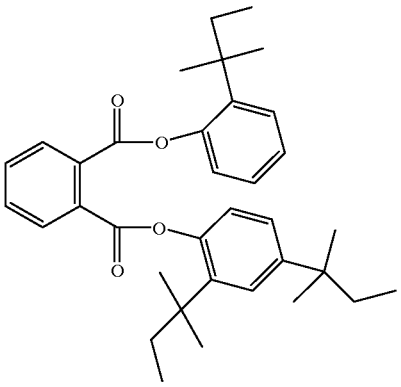
73.
$n\text{-}C_{17}H_{33}\text{—}COO\text{—}n\text{-}C_4H_9$
74.
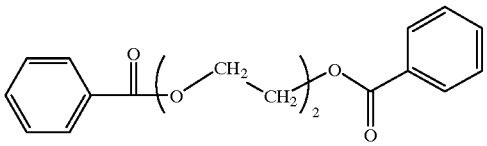
75.
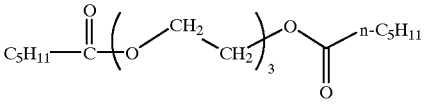
76.
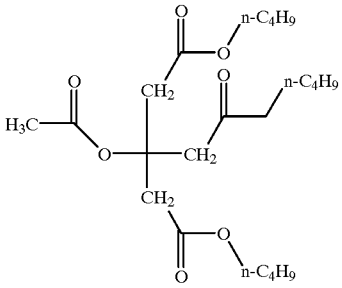
-continued
77.
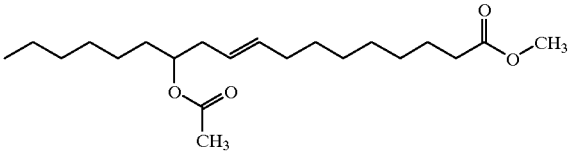
78.
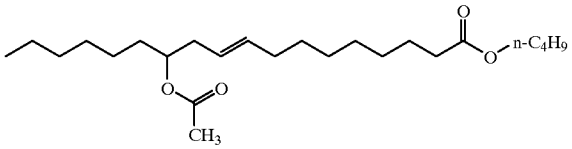
79.
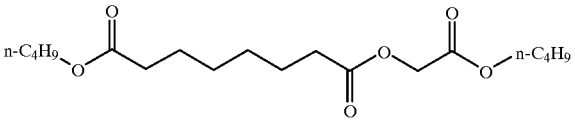
80.
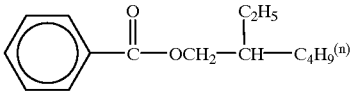
81.
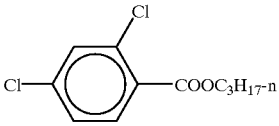
82.
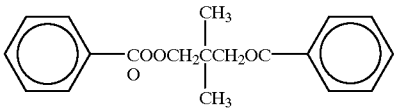
83.
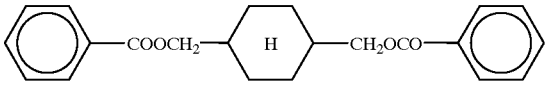
84.
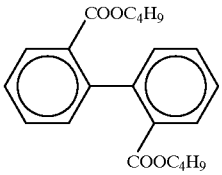
85.
$n\text{-}C_{15}H_{31}COOC_{16}H_{33}\text{-}n$
86.
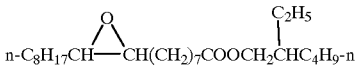
87.
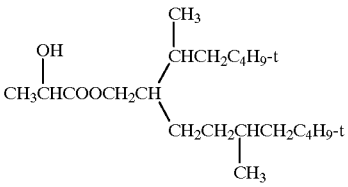

-continued
88.
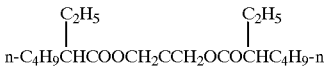
89.
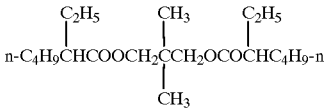
90.
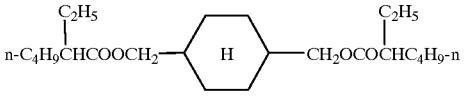
91.
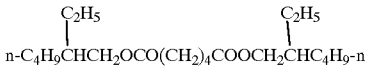
92.
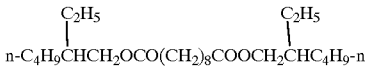
93.
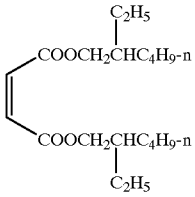
94.
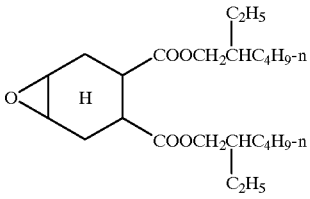
95.
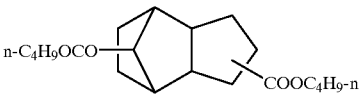
96.
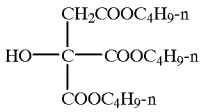
97.
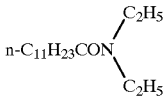
98.
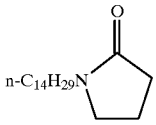
99.
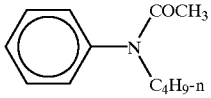
-continued
100.
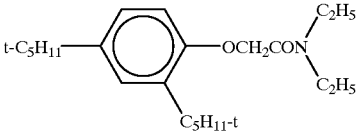
101.
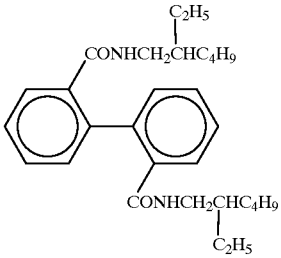
102.
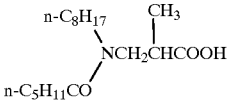
103.
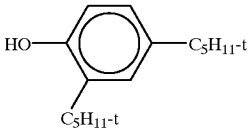
104.
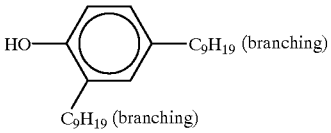
105.
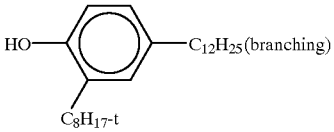
106.
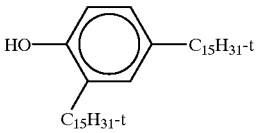
107.
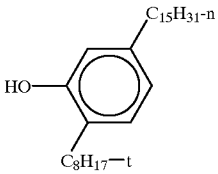
108.
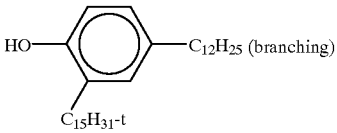

-continued

109.

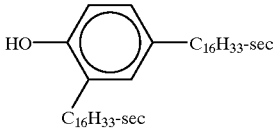

110.

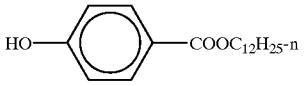

111.

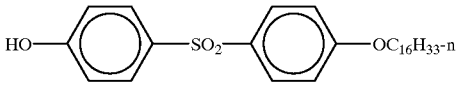

112.

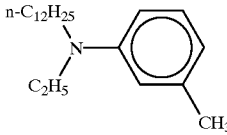

113.

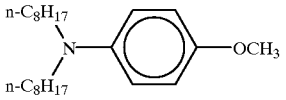

114.

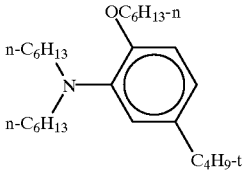

115.

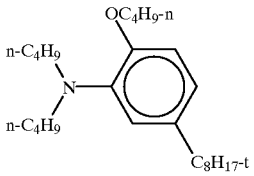

116.

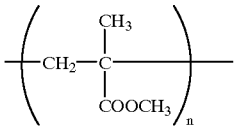

(weight-average molecular weight 20,000)

117.

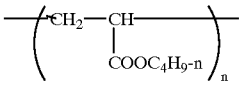

(weight-average molecular weight 50,000)

118.

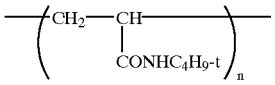

(weight-average molecular weight 60,000)

-continued

119.

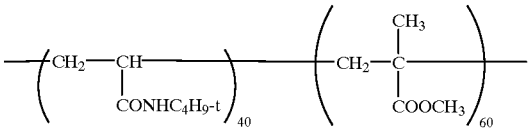

(weight-average molecular weight 40,000)

120.

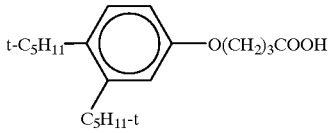

121.

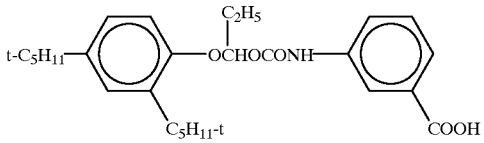

122.

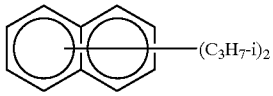

Cn $H_{2n+2}$ 123.

(the mixture of normal paraffin n=14, 15)

124.

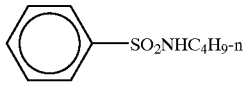

125.

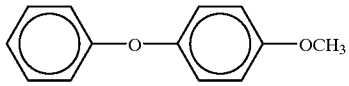

126.

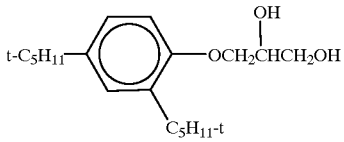

Chlorinated paraffin 127.

(average composition $C_{14}H_{24}Cl_6$)

Chlorinated paraffin 128.

(average composition $C_{12}H_{18}Cl_8$)

Poly(chlorotrifluoroethylene) 129.

(weight-average molecular weight 900)

130.

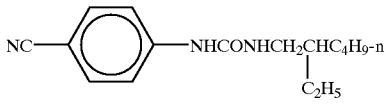

131.

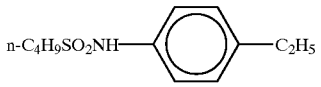

132.

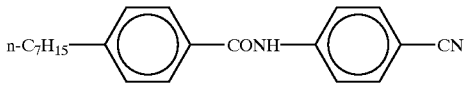

In the present invention, preferably at least one unit sensitive layer comprise three sensitive layers differing in sensitivity. Also, these three layers are preferably arranged in the order of a highest-sensitivity layer (Lo), a medium-sensitivity layer (Lm), and a lowest-sensitivity layer (Lu) from the farthest side from the support, and the oil phase viscosity ($v_1$) of Lo, the oil phase viscosity ($v_2$) of Lm, and the oil phase viscosity ($v_3$) of Lu at 50° C. have the following relationship.

$$v_2>1.5v_1$$

or $$v_3>1.5v_1$$

More preferably, the plastic deformation ratio ($\alpha_1$) of Lo, the plastic deformation ratio ($\alpha_2$) of Lm, and the plastic deformation ratio ($\alpha_3$) of Lu have the following relationship.

$$\alpha_2<0.95\alpha_1$$

or $$\alpha_3<0.95\alpha_1$$

In a light-sensitive material of the present invention, a unit red-sensitive layer, a unit green-sensitive layer, and a unit blue-sensitive layer are generally arranged in this order on a support. However, according to the intended use, this order of arrangement can be reversed, or sensitive layers sensitive to the same color can sandwich another sensitive layer sensitive to a different color. Non-sensitive layers can be formed between the silver halide sensitive layers and as the uppermost layer and the lowermost layer. These non-sensitive layers can contain, e.g., couplers, DIR compounds, and color amalgamation inhibitors to be described later. When each unit color-sensitive layer is constituted by a plurality of silver halide emulsion layers, two layers such as high- and low-speed emulsion layers are arranged such that the sensitivity lowers toward the support, as described in DE1,121,470 or GB923,045, the disclosures of which are incorporated herein by reference.

Also, as described in Jpn. Pat. Appln. KOKOKU Publication No.(hereinafter referred to as JP-B-)55-34932, the disclosure of which is incorporated herein by reference layers can be arranged from the farthest side from a support in the order of a blue-sensitive layer/a high-speed green-sensitive layer (GH)/a high-speed red-sensitive layer (RH)/a low-speed green-sensitive layer (GL)/a low-speed red-sensitive layer (RL). Furthermore, as described in JP-A-56-25738 and JP-A-62-63936, the disclosures of which are incorporated herein by reference, layers can be arranged from the farthest side from a support in the order of a high-speed blue-sensitive layer (BH)/a low-speed blue-sensitive layer (BL)/GL/RL/GH/RH.

In addition, the order of a high-speed emulsion layer/a low-speed emulsion layer/a medium-speed emulsion layer can be used. The arrangement can also be changed as described above even when four or more layers are formed.

To improve the color reproducibility, as described in U.S. Pat. Nos. 4,663,271, 4,705,744, 4,707,436, JP-A-62-160448, and JP-A-63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A preferable silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

Silver halide photographic emulsions usable in the present invention can be prepared by methods described in, e.g., "I. Emulsion preparation and types," Research Disclosure (RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in U.S. Pat. Nos. 3,574,628, 3,655,394, and GB1,413,748, the disclosures of which are incorporated herein by reference, are also preferable.

Tabular grains having an aspect ratio (the value obtained by dividing the equivalent-circle diameter of a tabular grain by the grain thickness) of about 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization before being used. Additives for use in these steps are described in RD Nos. 17643, 18716, and 307105, the disclosures of which are incorporated herein by reference, and they are summarized in a table to be presented later.

In a light-sensitive material of the present invention, two or more types of sensitive silver halide emulsions different in at least one of the grain size, grain size distribution, halogen composition, grain shape, and sensitivity can be mixed in the same layer.

In the present invention, it is preferable to apply surface-fogged silver halide grains described in U.S. Pat. No. 4,082,553, internally fogged silver halide grains described in U.S. Pat. No. 4,626,498 and JP-A-59-214852, the disclosures of which are incorporated herein by reference, and colloidal silver to sensitive silver halide emulsion layers and/or substantially non-sensitive hydrophilic colloid layers. The internally fogged or surface-fogged silver halide grain means a silver halide grain which can be developed uniformly (non-imagewise) regardless of whether the location is a non-exposed portion or an exposed portion of a light-sensitive material. A method of preparing the internally fogged or surface-fogged silver halide grain is described in U.S. Pat. No. 4,626,498 and JP-A-59-214852, the disclosures of which are incorporated herein by reference. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not substantially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably, 0.02 to 2 $\mu$m.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a light-sensitive material of the present invention is preferably 6.0 g/m$^2$ or less, and most preferably, 4.5 g/m$^2$ or less.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surface active agents | pages 26–27 | page 650, right column | pages 875–876 |
| 9. Antistatic agents | page 27 | page 650, right column | pages 876–877 |
| 10. Matting agents | | | pages 878–879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers: L-57 (page 11, lower right column), L-68 (page 12, lower right column), and L-77 (page 13, lower right column)in JP-A-3-39737; A-4-63 (page 134), and A-4-73 and A-4-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference, the disclosures of which are incorporated herein by reference.

Polymer couplers: P-1 and P-5 (page 11) in JP-A-2-44345, the disclosures of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of couplers which release a photographically useful group usable in the present invention are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildew proofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly a compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly a compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

The present invention can be applied to various color light-sensitive materials such as color negative films for general purposes or motion pictures, color reversal films for slides or television, color paper, color positive films, and color reversal paper. The present invention is also suited to film units with lens described in JP-B-2-32615 and Jpn. UM Appln. KOKOKU Publication No. 3-39784, the disclosures of which are incorporated herein by reference.

A support which can be suitably used in the present invention is described in, e.g., RD. No. 17643, page 28, RD. No. 18716, page 647, right column to page 648, left column, and RD. No. 307105, page 879, the disclosures of which are incorporated herein by reference.

In a light-sensitive material of the present invention, the total film thickness of all hydrophilic colloid layers on the side having emulsion layers, with respect to a support, is preferably 28 μm or less, more preferably, 23 μm or less, further preferably, 18 μm or less, and particularly preferably, 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129, the disclosure of which is incorporated herein by reference. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In a light-sensitive material of the present invention, hydrophilic colloid layers (to be referred to as back layers hereinafter) having a total dried film thickness of 2 to 20 μm are preferably formed on the side (to be referred to as a back surface hereinafter) opposite, with respect to a support, to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A light-sensitive material of the present invention can be developed by conventional methods described in RD. No. 17643, pp. 28 and 29, RD. No. 18716, page 651, left to right columns, and RD No. 307105, pp. 880 and 881, the disclosures of which are incorporated herein by reference.

Color negative film processing solutions used in the present invention will be described below. Compounds described in JP-A-4-121739, page 9, upper right column, line 1 to page 11, lower left column, line 4 , the disclosure of which is incorporated herein by reference, can be used in a color developer of the present invention. As a color developing agent used when particularly rapid processing is to be performed, 2-methyl-4-[N-ethyl-N-(2-hydroxyethyl) amino]aniline, 2-methyl-4-[N-ethyl-N-(3-hydroxypropyl) amino]aniline, or 2-methyl-4-[N-ethyl-N-(4-hydroxybutyl) amino]aniline is preferable.

The use amount of any of these color developing agents is preferably 0.01 to 0.08 mol, more preferably, 0.015 to 0.06 mol, and most preferably, 0.02 to 0.05 mol per liter (to be also referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Examples are N,N-di (sulfoethyl)hydroxylamine, monomethylhydroxylamine, dimethylhydroxylamine, monoethylhydroxylamine, diethylhydroxylamine, and N,N-di(carboxylethyl) hydroxylamine. Of these derivatives, N,N-di(sulfoethyl) hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L of a color developer. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L of a color developer. In a replenisher, sulfite is preferably used at a concentration 1.1 to 3 times the above concentration.

The pH of a color developer is preferably 9.8 to 11.0, and more preferably, 10.0 to 10.5. In a replenisher, the pH is preferably set to be higher by 0.1 to 1.0 than these values. To stably maintain this pH, a known buffering agent such as carbonate, phosphate, sulfosalicylate, or borate is used. The replenishment rate of a color developer is preferably 80 to 1,300 mL per $m^2$ of a light-sensitive material. However, the replenishment rate is preferably smaller in order to reduce environmental pollution. For example, the replenishment rate is preferably 80 to 600 mL, and more preferably, 80 to 400 mL.

The bromide ion concentration in a color developer is usually 0.01 to 0.06 mol per L of the color developer. However, this bromide ion concentration is preferably set at 0.015 to 0.03 mol per L in order to suppress fog and improve the discrimination and graininess while maintaining the sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into a color developer from 1 $m^2$ of a light-sensitive material when the sensitized material is color-developed V: the replenishment rate (L) of a color developer replenisher for 1 $m^2$ of a light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6, the disclosures of which is incorporated herein by reference, can be applied to a processing solution having bleaching capacity in the present invention. This bleaching agent preferably has an oxidation-reduction potential of 150 mV or more. Preferable practical examples of the bleaching agent are described in JP-A-5-72694 and JP-A-5-173312, the disclosures of which are incorporated herein by reference. In particular, 1,3-diaminopropane tetraacetic acid and ferric complex salt of a compound as practical example 1 in JP-A-5-173312, page 7, the disclosures of which are incorporated herein by reference, are preferable.

To improve the biodegradability of a bleaching agent, it is preferable to use compound ferric complex salts described in JP-A-4-251845, JP-A-4-268552, EP588,289, EP591,934, and JP-A-6-208213, the disclosures of which are incorporated herein by reference, as the bleaching agent. The concentration of any of these bleaching agents is preferably 0.05 to 0.3 mol per L of a solution having bleaching capacity. To maintain the bleaching capacity and reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$C_R = C_T \times (V_1 + V_2)/V_1 + C_p$$

where $C_R$: the concentrations of components in a replenisher $C_T$: the concentrations of components in a mother solution (processing tank solution)

$C_p$: the concentrations of components consumed during processing $V_1$ :the replenishment rate (mL) of a replenisher having bleaching capacity per $m^2$ of a light-sensitive material $V_2$ :the amount (mL) carried over from a pre-bath by $m^2$ of a light-sensitive material Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No. 17129, and U.S. Pat. No. 3,893,858, the disclosures of which are incorporated herein by reference, is preferable.

It is preferable to replenish 50 to 1,000 mL of a bleaching replenisher to a bleaching solution per $m^2$ of a light-sensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19, the disclosure of which is incorporated herein by reference, can be applied to a processing solution with fixing capacity. To improve the fixing rate and preservability, compounds represented by formulas (I) and (II) described in JP-A-6-301169, the disclosures of which are incorporated herein by reference, are preferably added singly or together to a processing solution with fixing capacity. To improve the preservability, the use of sulfinic acid such as p-toluenesulfinate described in JP-A-1-224762, the disclosure of which is incorporated herein by reference, is also preferable. To improve the desilvering characteristics, ammonium is preferably used as cation in a solution with bleaching capacity or a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059, the disclosure of which is incorporated herein by reference.

The replenishment rate of a replenisher in the bleach-fixing or fixing step is preferably 100 to 1,000 mL, more preferably, 150 to 700 mL, and most preferably, 200 to 600 mL per $m^2$ of a light-sensitive material. In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the system with the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferable.

Contents described in aforementioned JP-A-4-125558, page 12, lower right column, line 6 to page 13, lower right column, line 16, the disclosures of which are incorporated herein by reference, can be preferably applied to the washing and stabilization steps. To improve the safety of the work environment, it is preferable to use azolylmethylamines described in EP504,609 and EP519,190 or N-methylolazoles described in JP-A-4-362943, the disclosures of which are incorporated herein by reference, instead of formaldehyde in a stabilizer and to make a magenta coupler divalent to form a solution of surfactant containing no image stabilizing agent such as formaldehyde. To reduce adhesion of dust to a magnetic recording layer formed on a light-sensitive material, a stabilizer described in JP-A-6-289559, the disclosure of which is incorporated herein by reference, can be preferably used.

The replenishment rate of washing water and a stabilizer is preferably 80 to 1,000 mL, more preferably, 100 to 500 mL, and most preferably, 150 to 300 mL per $m^2$ of a light-sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030, the disclosures of which are incorporated herein by reference. The reverse permeable membrane used in this processing is preferably a low-pressure reverse permeable membrane.

In the processing of the present invention, it is particularly preferable to perform processing solution evaporation correction disclosed in JIII Journal of Technical Disclosure No. 94-4992, the disclosure of which is incorporated herein by reference. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same JIII Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in PCT No. 57-500485, the disclosures of which are incorporated herein by reference. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/m$^2$·24 hrs·atm or less.

Color reversal film processing solutions used in the present invention will be described below.

Processing for a color reversal film is described in detail in Aztech Ltd., Known Technology No. 6 (Apr. 1, 1991), page 1, line 5 to page 10, line 5 and page 15, line 8 to page 24, line 2, the disclosure of which is incorporated herein by reference, and any of the contents can be preferably applied.

In this color reversal film processing, an image stabilizing agent is contained in a control bath or a final bath. Preferable examples of this image stabilizing agent are formalin, sodium formaldehyde-bisulfite, and N-methylolazoles. Sodium formaldehyde-bisulfite or N-methylolazoles are preferable in terms of work environment, and N-methyloltriazole is particularly preferable as N-methylolazoles. The contents pertaining to a color developer, bleaching solution, fixing solution, and washing water described in the color negative film processing can be preferably applied to the color reversal film processing.

Preferable examples of color reversal film processing agents containing the above contents are the E-6 processing agent manufactured by Eastman Kodak Co. and the CR-56 processing agent manufactured by Fuji Photo Film Co., Ltd.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is particularly preferable as the magnetic grains. The grain can take the shape of any of, e.g., a needle, rice grain, sphere, cube, and plate. The specific area is preferably 20 m$^2$/g or more, and more preferably 30 m$^2$/g or more as $S_{BET}$. The saturation magnetization ($\sigma s$) of the ferromagnetic substance is preferably $3.0\times10^4$ to $3.0\times10^5$ A/m, and most preferably $4.0\times10^4$ to $2.5\times10^5$ mA/m. A surface treatment can be performed for the ferro-magnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used together with the magnetic grains, it is possible to use a thermoplastic resin described in JP-A-4-219569, the disclosure of which is incorporated herein by reference, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight-average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. Examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 g/m$^2$, preferably 0.01 to 2 g/m$^2$, and more preferably 0.02 to 0.5 g/m$^2$. The transmitting yellow density of the magnetic recording layer is preferably 0.01 to 0.50, more preferably 0.03 to 0.20, and most preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference, is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. Nos. 5,336,589, 5,250,404, 5,229,259, 5,215,874, and EP466,130, the disclosures of which are incorporated herein by reference.

A polyester support used in the present invention will be described below. Details of the polyester support and sensitive materials, processing, cartridges, and examples (to be described later) are described in Journal of Technical Disclosure No. 94-6023 (JIII; Mar. 15, 1994), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is most preferred among other polymers. The weight-average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg−20° C. to less than Tg. The heat treatment can be performed at a fixed temperature within this range or can be performed together with cooling. The heat treatment time is 0.1 to 1500 hr, more preferably 0.5 to 200 hr. The heat treatment can be performed for a roll-like support or while a support is conveyed in the form of a web. The surface shape can also be improved by roughening the surface (e.g., coating the surface with fine conductive inorganic grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Of these surface treatments, the ultraviolet radiation treatment, flame treatment, corona discharge treatment, and glow discharge treatment are preferable.

An undercoating method will be described below. A light-sensitive material of the present invention can comprise an undercoating layer on at least one of the emulsion surface or the back surface. An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 $\mu$m) can also be contained as a matting agent.

A light-sensitive material of the present invention cal also contain an antistatic agent. Examples of this antistatic agent are carboxylic acid, carboxylate, a macromolecule containing sulfonate, a cationic macromolecule, and an ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably $10^5$ Ω·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides. The content in a light-sensitive material is preferably 5 to 500 mg/m$^2$, and most preferably 10 to 350 mg/m$^2$. The weight ratio of a conductive crystalline oxide or its composite oxide to the binder is preferably 1/300 to 100/1, and more preferably 1/100 to 100/5.

A light-sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60%RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m) grains, polystyrene grains (0.25 $\mu$m), and colloidal silica grains (0.03 $\mu$m).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$ Ω or less at 25° C. and 25%RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of the present 135-size 25-mm cartridge to 22 mm or less. The volume of a cartridge case is preferably 30 $cm^3$ or less, and more preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for an advanced photo system (to be referred to as an APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as Fuji Film EPION Series (e.g., EPION 300Z). A color photosensitive film of the present invention is also suited as a film with lens such as the Fuji Film FUJICOLOR UTSURUNDESU SUPER SLIM.

A photographed film is printed through the following steps in a miniature laboratory system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably Fuji Film SUPER FA8])

(6) Collation and shipment (the cartridge and the index print are collated by an ID number and shipped together with the prints)

As these systems, the Fuji Film MINILABO CHAMPION SUPER FA-298, FA-278, FA-258, FA-238 and the Fuji Film DIGITAL LABO SYSTEM FRONTIER are preferable. Examples of a processor for the MINILABO CHAMPION are the FP922AL, FP562B, FP562BAL, FP362B, and FP362BAL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and recommended processing chemicals are the FUJICOLOR JUST-IT CP-47L and CP40FAII. In the FRONTIER SYSTEM, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

The APS can also be enjoyed by the PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film Application Software Photo Factory. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, AP-1 POP KG, or the CARTRIDGE FILE 16 is preferable.

[Making of Sample 101]

An undercoated cellulose triacetate film support was coated with multiple layers having compositions presented below to make sample 101 as a multilayered color light-sensitive material.

(Compositions of Sensitive Layers)

The main materials used in the individual layers are classified as follows.

ExC: Cyan coupler

UV: Ultraviolet absorbent

ExM: Magenta coupler HBS:

High-boiling organic solvent

ExY: Yellow coupler

H: Gelatin hardener

ExS: Sensitizing dye

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

(Sample 101)

| | | |
|---|---|---|
| 1st layer (1st antihalation layer) | | |
| Black colloidal silver | silver | 0.170 |
| Silver iodobromide emulsion P | silver | 0.01 |
| Gelatin | | 0.95 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.060 |
| Gelatin | | 0.415 |
| ExM-1 | | 0.040 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| Silver iodobromide emulsion O | | 0.025 |
| ExC-2 | | 0.028 |
| Polyethylacrylate latex | | 0.090 |
| Gelatin | | 0.275 |
| 4th layer (Low-speed red-sensitive emulsion layer) | | |
| Silver iodobromide emulsion A | silver | 0.310 |
| ExS-1 | | $5.5 \times 10^{-4}$ |
| ExS-2 | | $1.0 \times 10^{-6}$ |
| ExS-3 | | $2.4 \times 10^{-4}$ |
| ExC-1 | | 0.115 |
| ExC-3 | | 0.025 |
| ExC-4 | | 0.087 |
| ExC-5 | | 0.013 |
| ExC-6 | | 0.003 |
| ExC-7 | | 0.025 |
| Cpd-2 | | 0.025 |
| Cpd-4 | | 0.025 |
| HBS-1 | | 0.18 |
| Gelatin | | 0.83 |

-continued

| | | |
|---|---|---|
| 5th layer (Medium-speed red-sensitive emulsion layer) | | |
| Silver iodobromide emulsion B | silver | 0.24 |
| Silver iodobromide emulsion C | silver | 0.50 |
| ExS-1 | | $5.0 \times 10^{-4}$ |
| ExS-2 | | $1.0 \times 10^{-6}$ |
| ExS-3 | | $2.0 \times 10^{-4}$ |
| ExC-1 | | 0.12 |
| ExC-2 | | 0.023 |
| ExC-3 | | 0.018 |
| ExC-4 | | 0.12 |
| ExC-5 | | 0.016 |
| ExC-6 | | 0.005 |
| ExC-7 | | 0.010 |
| ExC-9 | | 0.004 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion D | silver | 1.42 |
| ExS-1 | | $3.7 \times 10^{-4}$ |
| ExS-2 | | $1 \times 10^{-6}$ |
| ExS-3 | | $1.8 \times 10^{-4}$ |
| ExC-1 | | 0.22 |
| ExC-3 | | 0.11 |
| ExC-6 | | 0.028 |
| ExC-7 | | 0.010 |
| ExC-9 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (Layer for donating interimage effect to red-sensitive layer) | | |
| Silver iodobromide emulsion E | silver | 0.580 |
| ExS-6 | | $1.7 \times 10^{-4}$ |
| ExS-10 | | $4.6 \times 10^{-4}$ |
| Cpd-4 | | 0.029 |
| ExM-2 | | 0.100 |
| ExM-3 | | 0.029 |
| ExY-1 | | 0.025 |
| ExC-7 | | 0.003 |
| ExC-9 | | 0.014 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion F | silver | 0.35 |
| Silver iodobromide emulsion G | silver | 0.25 |
| Silver iodobromide emulsion H | silver | 0.39 |
| ExS-4 | | $2.4 \times 10^{-6}$ |
| ExS-5 | | $1.0 \times 10^{-4}$ |
| ExS-6 | | $3.9 \times 10^{-4}$ |
| ExS-7 | | $7.7 \times 10^{-6}$ |
| ExS-8 | | $3.3 \times 10^{-4}$ |
| ExM-2 | | 0.35 |
| ExM-3 | | 0.049 |
| ExC-7 | | 0.003 |
| HBS-1 | | 0.28 |
| HBS-3 | | 0.01 |
| HBS-4 | | 0.27 |
| Gelatin | | 1.37 |
| 10th layer (Medium-speed green-sensitive emulsion layer) | | |
| Silver iodobromide emulsion I | silver | 0.43 |
| ExS-4 | | $5.3 \times 10^{-6}$ |

-continued

| | | |
|---|---|---|
| ExS-7 | | $1.5 \times 10^{-4}$ |
| ExS-8 | | $6.3 \times 10^{-4}$ |
| ExC-6 | | 0.007 |
| ExC-7 | | 0.004 |
| ExC-9 | | 0.006 |
| ExM-2 | | 0.032 |
| ExM-3 | | 0.024 |
| ExY-1 | | 0.005 |
| ExM-4 | | 0.028 |
| HBS-1 | | 0.064 |
| HBS-3 | | $2.1 \times 10^{-3}$ |
| Gelatin | | 0.45 |
| 11th layer (High-speed green-sensitive emulsion layer) | | |
| Silver iodobromide emulsion I | silver | 0.17 |
| Silver iodobromide emulsion J | silver | 0.92 |
| ExS-4 | | $4.1 \times 10^{-6}$ |
| ExS-7 | | $1.1 \times 10^{-4}$ |
| ExS-8 | | $4.9 \times 10^{-4}$ |
| ExC-6 | | 0.003 |
| ExC-7 | | 0.004 |
| ExC-9 | | 0.003 |
| ExM-1 | | 0.014 |
| ExM-3 | | 0.034 |
| ExM-4 | | 0.022 |
| ExM-5 | | 0.005 |
| ExY-5 | | 0.004 |
| ExM-2 | | 0.013 |
| Cpd-3 | | 0.004 |
| Cpd-4 | | 0.007 |
| HBS-1 | | 0.18 |
| HBS-3 | | $4 \times 10^{-4}$ |
| Polyethylacrylate latex | | 0.099 |
| Gelatin | | 1.15 |
| 12th layer (Yellow filter layer) | | |
| Yellow colloidal silver | silver | 0.047 |
| Cpd-1 | | 0.16 |
| Solid disperse dye ExF-5 | | 0.020 |
| Solid disperse dye ExF-6 | | 0.020 |
| Oil-soluble dye ExF-7 | | 0.010 |
| Solid disperse dye ExF-8 | | 0.140 |
| HBS-1 | | 0.082 |
| Gelatin | | 1.066 |
| 13th layer (Low-speed blue-sensitive emulsion layer) | | |
| Silver iodobromide emulsion K | silver | 0.20 |
| Silver iodobromide emulsion L | silver | 0.18 |
| Silver iodobromide emulsion M | silver | 0.07 |
| ExS-9 | | $4.4 \times 10^{-4}$ |
| ExS-10 | | $4.0 \times 10^{-4}$ |
| ExC-1 | | 0.035 |
| ExC-7 | | 0.010 |
| ExC-8 | | 0.010 |
| ExC-9 | | 0.012 |
| ExY-1 | | 0.024 |
| ExY-2 | | 0.78 |
| ExY-3 | | 0.08 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.45 |

-continued

| | | |
|---|---|---|
| 14th layer (High-speed blue-sensitive emulsion layer) | | |
| Silver iodobromide emulsion N | silver | 0.80 |
| ExS-9 | | $3.6 \times 10^{-4}$ |
| ExC-1 | | 0.010 |
| ExC-7 | | 0.003 |
| ExC-9 | | 0.001 |
| ExY-2 | | 0.33 |
| ExY-3 | | 0.04 |
| ExY-6 | | 0.060 |
| Cpd-2 | | 0.075 |
| Cpd-3 | | $1.0 \times 10^{-3}$ |
| HBS-1 | | 0.10 |
| Gelatin | | 0.99 |
| 15th layer (1st protective layer) | | |
| Silver iodobromide emulsion O | silver | 0.30 |
| UV-1 | | 0.21 |
| UV-2 | | 0.13 |
| UV-3 | | 0.20 |
| UV-4 | | 0.025 |
| F-11 | | 0.009 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 $\mu$m) | | $5.0 \times 10^{-2}$ |
| B-2 (diameter 1.7 $\mu$m) | | 0.15 |
| B-3 | | 0.15 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, iridium salt, ruthenium salt, and rhodium salt. Additionally, a sample was manufactured by adding $8.5 \times 10^{-3}$ g and $7.9 \times 10^{-3}$ g, per mol of a silver halide, of calcium in the form of an aqueous calcium nitrate solution to the coating solutions of the 8th and 11th layers, respectively.

Table 1 below shows the AgI contents, grain sizes, surface iodide contents, and the like of the emulsions A to P indicated by abbreviations above. The surface iodide content can be checked as follows by using XPS. Each sample was cooled to −115° C. in a vacuum of $1 \times 10^{-6}$ Pa or less, and MgK was radiated as probe X-rays at an X-ray source voltage of 8 kV and an X-ray current of 20 mA, thereby measuring Ag3d5/2, Br3d, and I3d5/2 electrons. The integral intensity of the measured peak was corrected by a sensitivity factor. From these intensity ratios, the surface iodide content was calculated.

TABLE 1

| Emulsion Name Emulsion | Average iodide content (mol %) | Variation coefficient (%) of inter-grain iodide distribution | Averaqe grain size (equivalent-sphere diameter; $\mu$m) | Variation coefficient (%) of equivalent-sphere diameter | Projected surface area (equivalent-circle diameter: $\mu$m) | Diameter/thickness ratio | Surface iodide content (mol%) | Grain shape |
|---|---|---|---|---|---|---|---|---|
| A | 3.9 | 20 | 0.37 | 19 | 0.40 | 2.7 | 2.3 | Tabular grain |
| B | 5.1 | 17 | 0.52 | 21 | 0.67 | 5.2 | 3.5 | Tabular grain |
| C | 7.0 | 18 | 0.86 | 22 | 1.27 | 5.9 | 5.2 | Tabular grain |

TABLE 1-continued

| Emulsion Name Emulsion | Average iodide content (mol %) | Variation coefficient (%) of inter-grain iodide distribution | Averaqe grain size (equivalent-sphere diameter; μm) | Variation coefficient (%) of equivalent-sphere diameter | Projected surface area (equivalent-circle diameter: μm) | Diameter/ thickness ratio | Surface iodide content (mol%) | Grain shape |
|---|---|---|---|---|---|---|---|---|
| D | 4.2 | 17 | 1.00 | 18 | 1.53 | 6.5 | 2.8 | Tabular grain |
| E | 7.2 | 22 | 0.87 | 22 | 1.27 | 5.7 | 5.3 | Tabular grain |
| F | 2.6 | 18 | 0.28 | 19 | 0.28 | 1.3 | 1.7 | Tabular grain |
| G | 4.0 | 17 | 0.43 | 19 | 0.58 | 3.3 | 2.3 | Tabular grain |
| H | 5.3 | 18 | 0.52 | 17 | 0.79 | 6.5 | 4.7 | Tabular grain |
| I | 5.5 | 16 | 0.73 | 15 | 1.03 | 5.5 | 3.1 | Tabular grain |
| J | 7.2 | 19 | 0.93 | 18 | 1.45 | 5.5 | 5.4 | Tabular grain |
| K | 1.7 | 18 | 0.40 | 16 | 0.52 | 6.0 | 2.1 | Tabular grain |
| L | 8.7 | 22 | 0.64 | 18 | 0.86 | 6.3 | 5.8 | Tabular grain |
| M | 7.0 | 20 | 0.51 | 19 | 0.82 | 5.0 | 4.9 | Tabular grain |
| N | 6.5 | 22 | 1.07 | 24 | 1.52 | 7.3 | 3.2 | Tabular grain |
| O | 1.0 | — | 0.07 | — | 0.07 | 1.0 | — | Uniform structure |
| P | 0.9 | — | 0.07 | — | 0.07 | 1.0 | — | Uniform structure |

In Table 1, (1) The emulsions L to O were subjected to reduction sensitization during grain preparation by using thiourea dioxide and thiosulfonic acid in accordance with examples in EP348934A, the disclosure of which is incorporated herein by reference.

(2) The emulsions A to O were subjected to gold sensitization, sulfur sensitization, and selenium sensitization in the presence of the spectral sensitizing dyes described in the individual sensitive layers and sodium thiocyanate in accordance with examples in EP443453A, the disclosure of which is incorporated herein by reference.

(3) The tabular grains were prepared by using low-molecular-weight gelatin in accordance with examples in JP-A-1-158426, the disclosure of which is incorporated herein by reference.

(4) Dislocation lines as described in EP443453A, the disclosure of which is incorporated herein by reference, were observed in the tabular grains by using a high-voltage electron microscope.

Preparation of Dispersions of Organic Solid Disperse Dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions of ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549,489A, the disclosure of which is incorporated herein by reference. The average grain size was found to be 0.06 μm.

A solid dispersion of ExF-8 was dispersed by the following method.

Water and 70 g of W-2 were added to 1,400 g of a wet cake of ExF-8 containing 30% of water, and 70 g of ExF-8 were added to form a slurry in which the concentration of ExF-8 was 30%. Subsequently, the ULTRA VISCO MILL (UVM-2) manufactured by Imex K.K. was filled with 1,700 mL of zirconia beads having an average grain size of 0.5 mm. The slurry was milled by passing it through the mill for 8 hr at a peripheral speed of about 10 m/sec and a discharge amount of 0.5 L/min.

Compounds used in the formation of each layer were as follows.

ExC-1

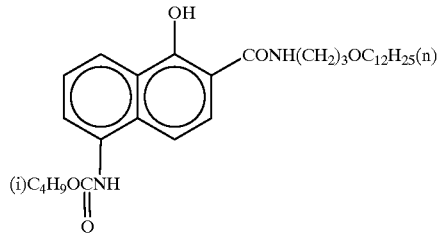

-continued
ExC-2
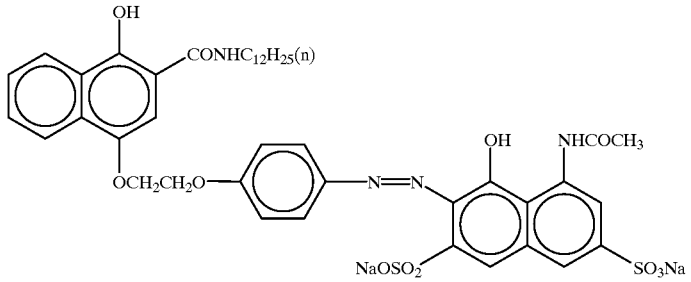
ExC-3
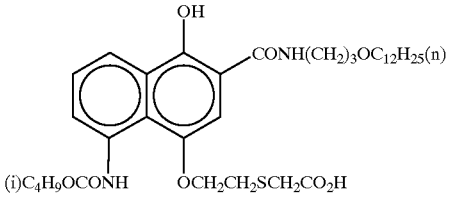
ExC-4
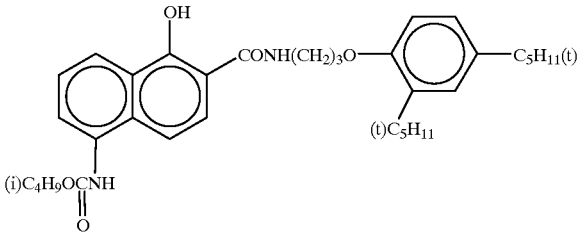
ExC-5
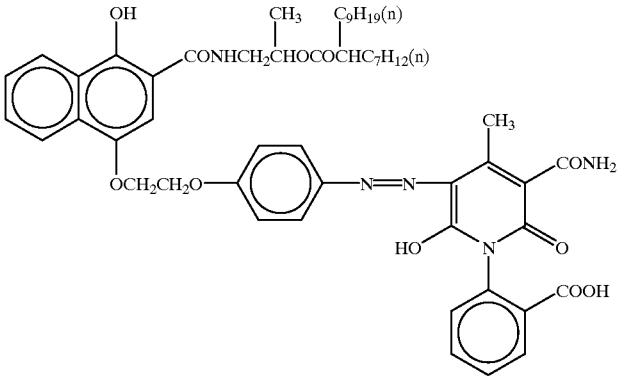
ExC-6
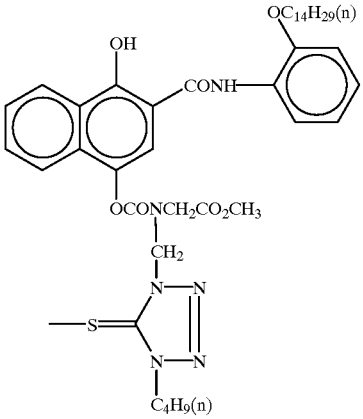

-continued
ExC-7
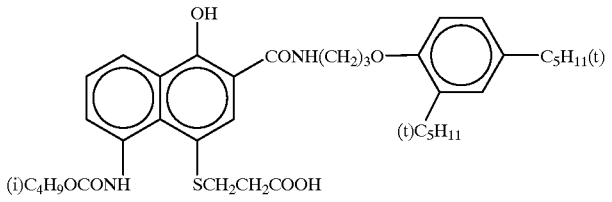
ExC-8
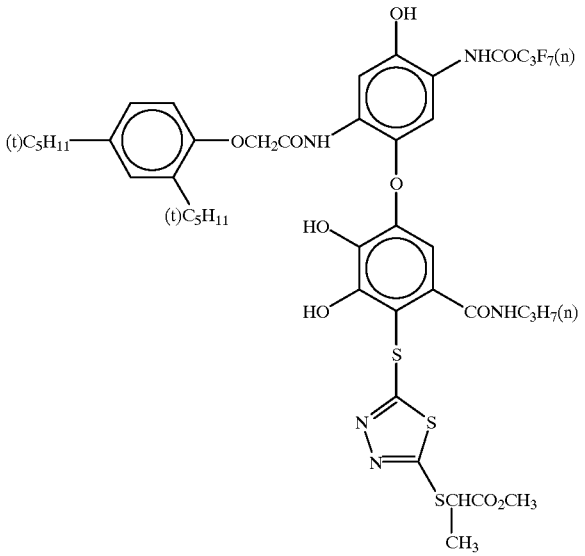
ExC-9
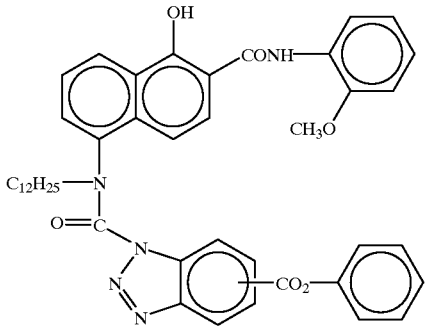
ExM-1
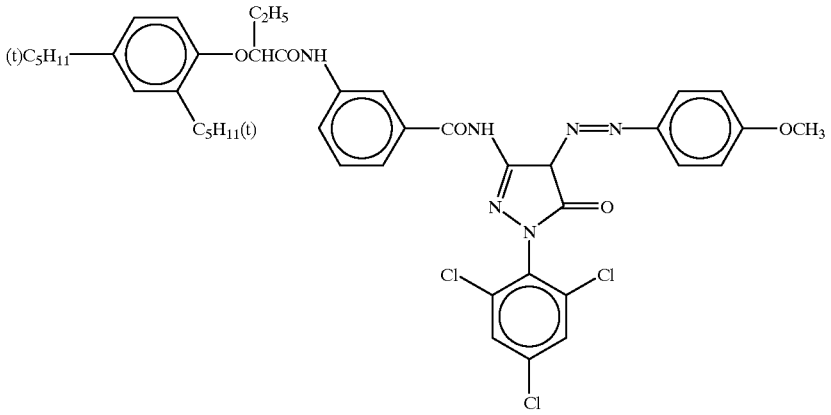

-continued
ExM-2
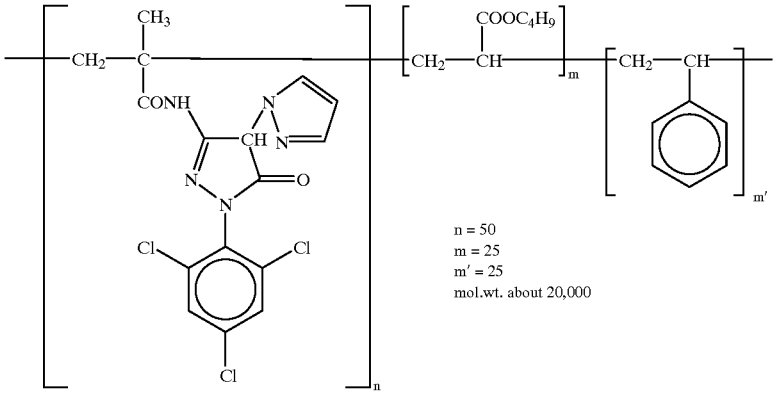
ExM-3
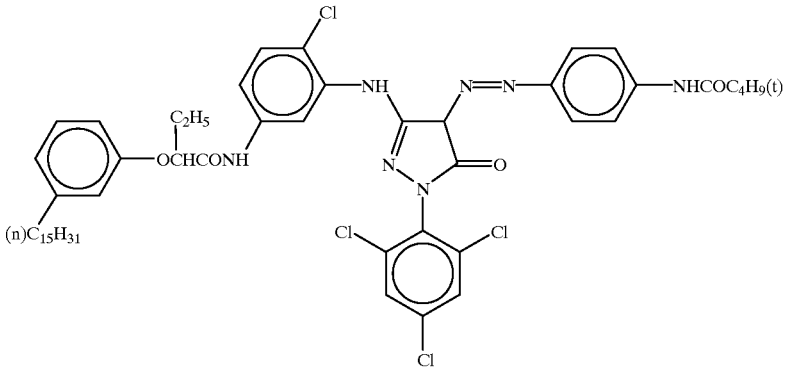
ExM-4
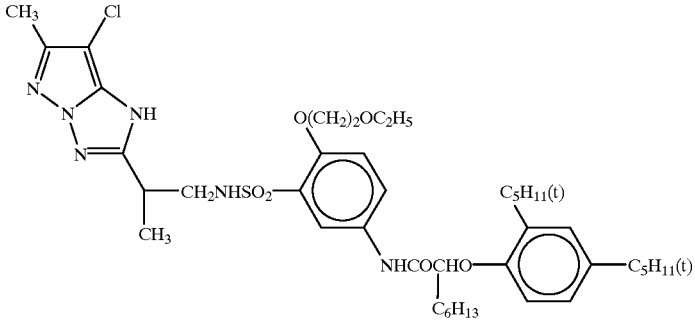
ExM-5
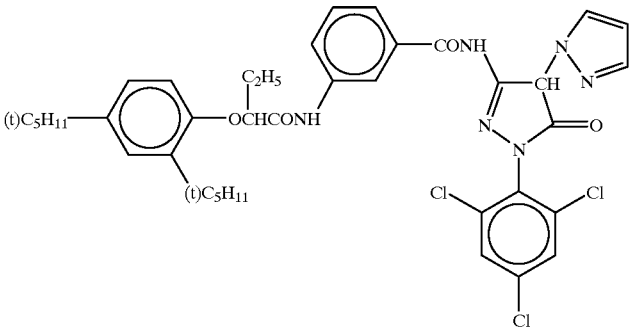

-continued
ExY-1
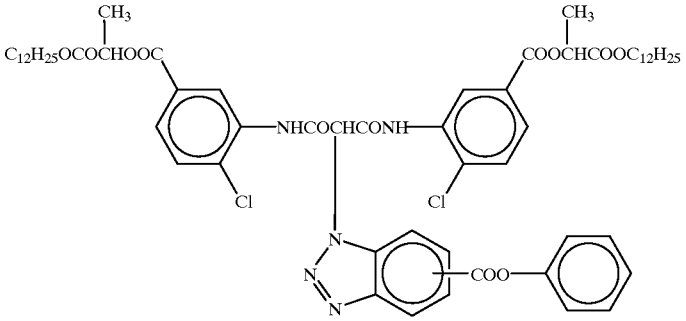
ExY-2
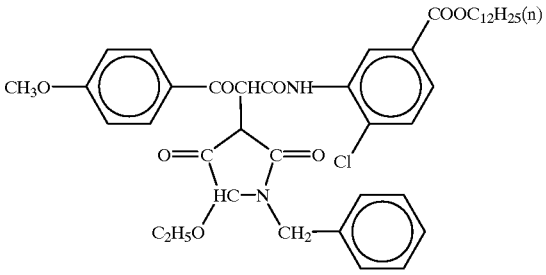
ExY-3
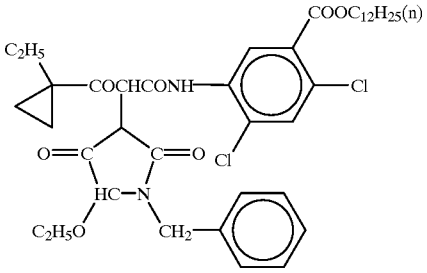
ExY-4
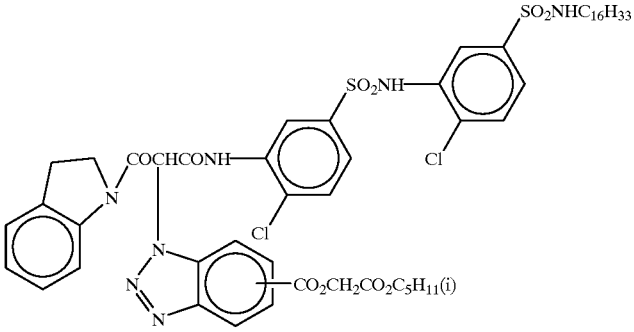
ExY-5
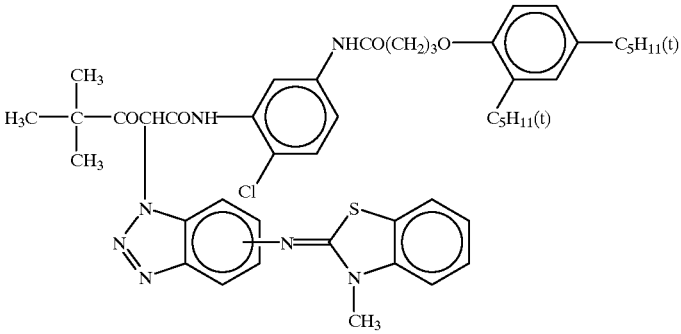

-continued
ExY-6
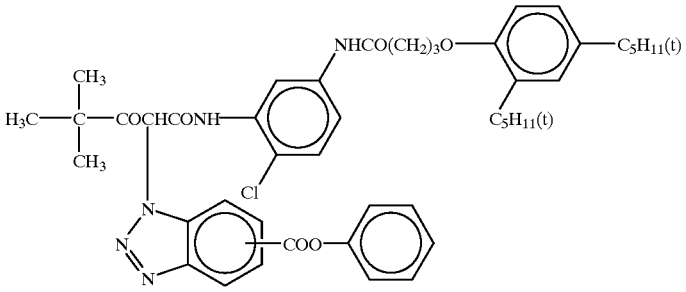
ExF-1
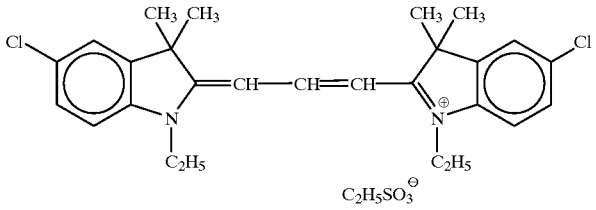
ExF-2
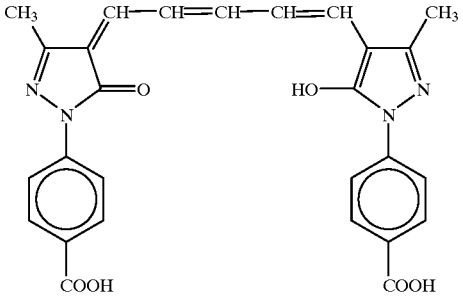
ExF-3
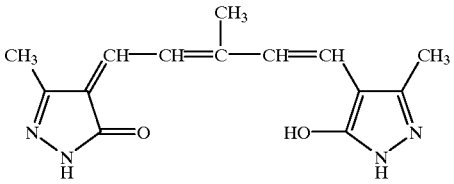
ExF-4
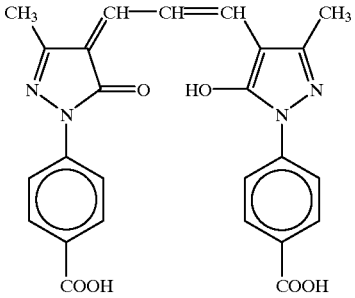

-continued
ExF-5
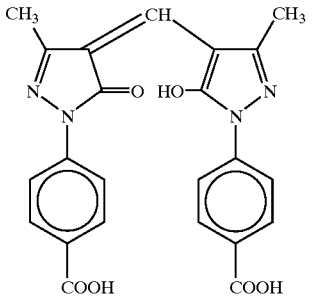
ExF-6
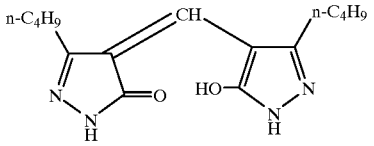
ExF-7
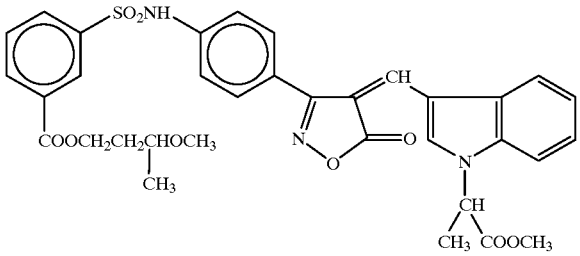
ExF-8
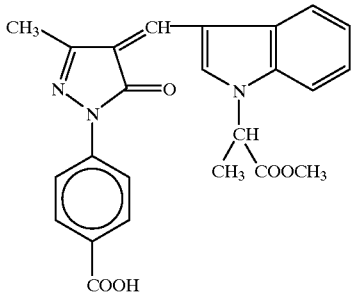
Cpd-1
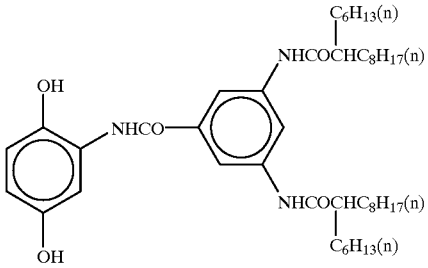
Cpd-2
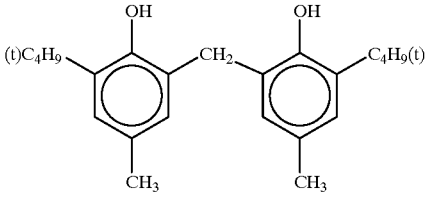

-continued
Cpd-3
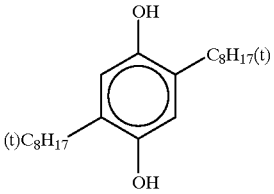
Cpd-4
n-$C_{14}H_{29}OCOCH_2CH_2CONOH$
$CH_3$
UV-1
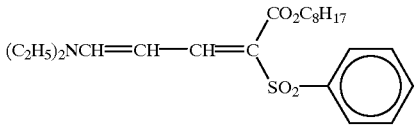
UV-2
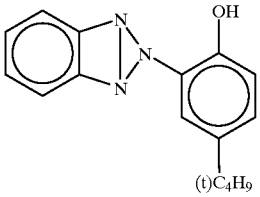
UV-3
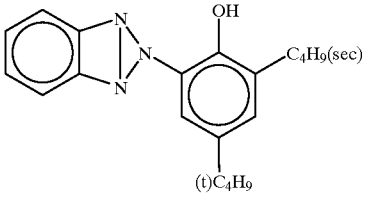
UV-4
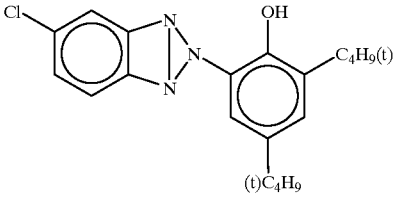
HBS-1
tricresyl phosphate
HBS-2
di-n-butyl phthalate
HBS-3
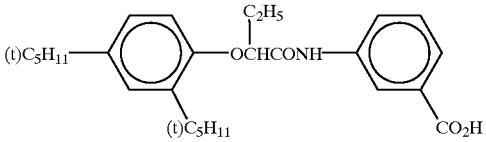
HBS-4
tri(2-ethylhexyl)phosphate
ExS-1
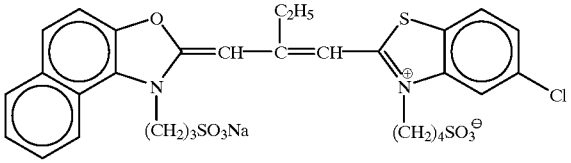

-continued
ExS-2
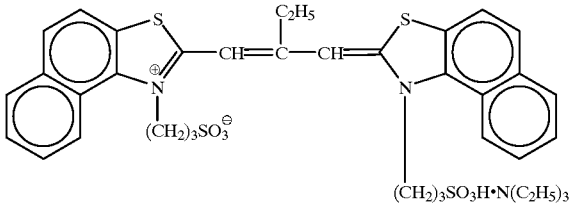
ExS-3
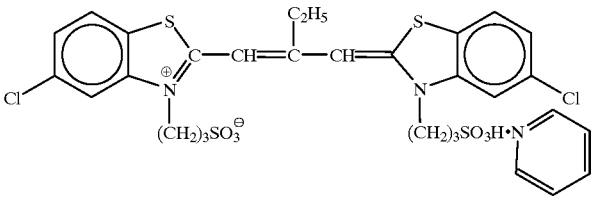
ExS-4
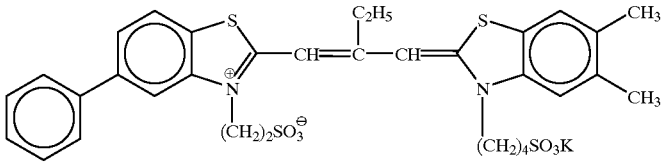
ExS-5
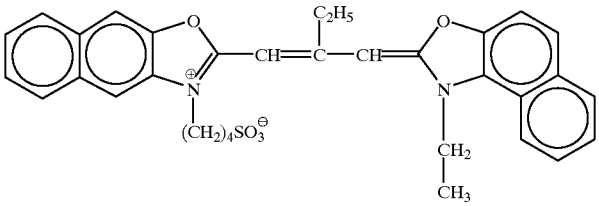
ExS-6
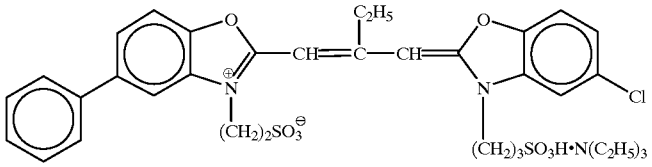
ExS-7
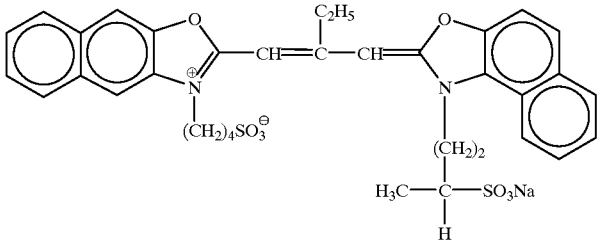
ExS-8
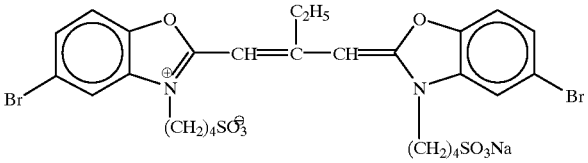

-continued
ExS-9
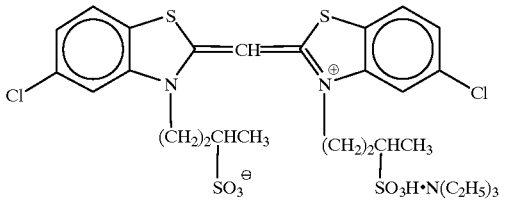
ExS-10
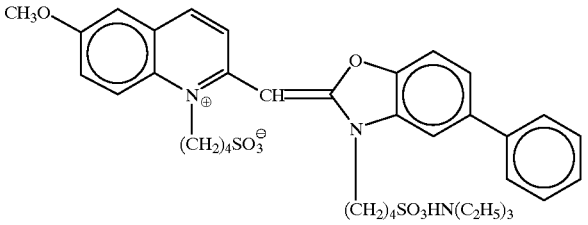
S-1
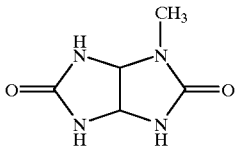
H-1
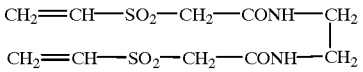
B-1
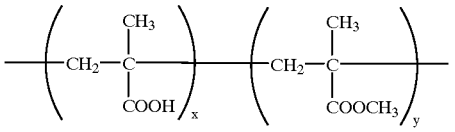
x/y = 10/90 (weight ratio)
weight-average molecular
weight: about 35,000
B-2
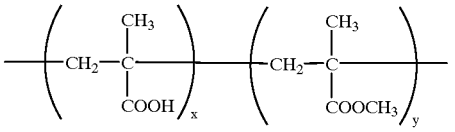
x/y = 40/60 (weight ratio)
weight-average molecular
weight: about 20,000
B-3
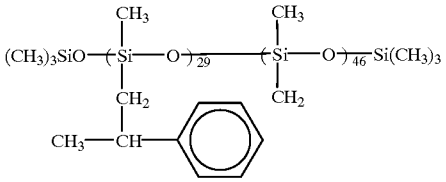
(mol ratio)
weight-average molecular
weight: about 8,000

-continued
B-4
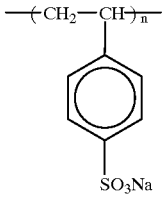
weight-average molecular weight: about 750,000
B-5
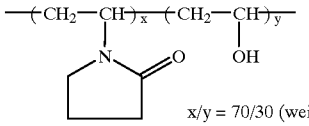
x/y = 70/30 (weight ratio)
weight-average molecular weight: about 17,000
B-6
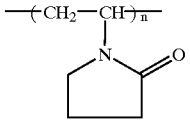
weight-average molecular weight: about 10,000
W-1
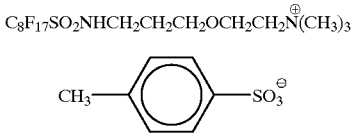
W-2
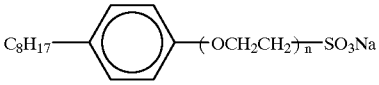
n =2 to 4
W-3
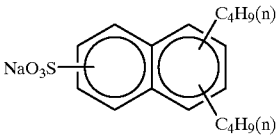
W-4
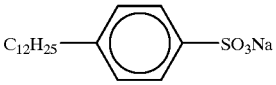
W-5
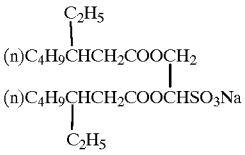
F-1
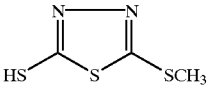

-continued
F-2
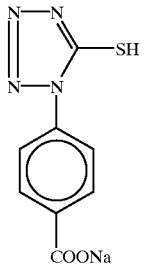
F-3
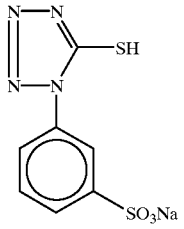
F-4
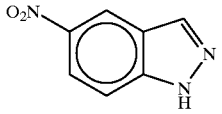
F-5
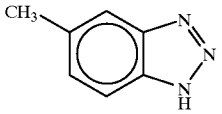
F-6
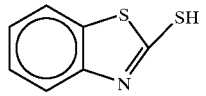
F-7
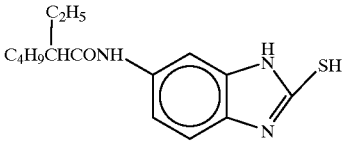
F-8
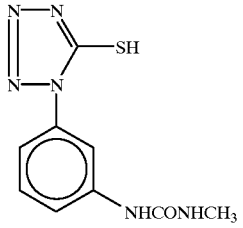
F-9
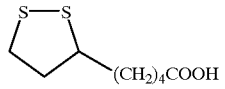
F-10
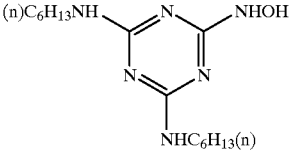

-continued
F-11
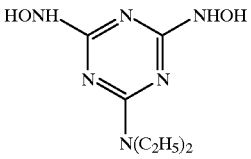
F-12
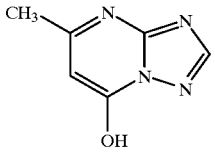
F-13
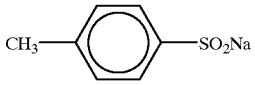
F-14
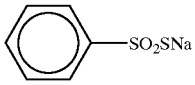
F-15
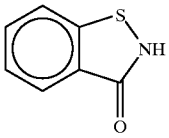
F-16
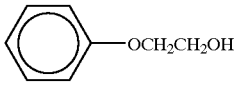
F-17
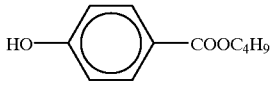
F-18
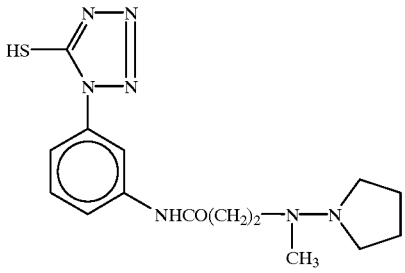
A method of developing each sample will be presented below.
(Processing Method)
| Process | Time | Temperature |
|---|---|---|
| Color development | 3 min. 15 sec. | 38° C. |
| Bleaching | 3 min. 00 sec. | 38° C. |
| Washing | 30 sec. | 24° C. |
-continued
(Processing Method)
| Process | Time | Temperature |
|---|---|---|
| Fixing | 3 min. 00 sec. | 38° C. |
| Washing (1) | 30 sec. | 24° C. |
| Washing (2) | 30 sec. | 24° C. |
| Stabilization | 30 sec. | 38° C. |
| Drying | 4 min. 20 sec. | 55° C. |

The compositions of the processing solutions were as follows.

| | (unit: g) |
|---|---|
| (Color developer) | |
| Diethylenetriaminepentaacetate | 1.0 |
| 1-hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 L |
| pH (adjusted by potassium hydroxide and sulfuric acid) | 10.05 |
| (Bleach-fixing solution) | |
| Ferric Sodium ethylenediamine-tetraacetate trihydrate | 100.0 |
| Disodium ethylenediaminetetraacetate | 10.0 |
| 3-mercapto-1,2,4-triazole | 0.03 |
| Ammonium bromide | 140.0 |
| Ammonium nitrate | 30.0 |
| Ammonia water (27%) | 6.5 mL |
| Water to make | 1.0 L |
| pH (adjusted by ammonia water and nitric acid) | 6.0 |
| (Fixing solution) | |
| Disodium ethylenediaminetetraacetate | 0.5 |
| Ammonium sulfite | 20.0 |
| Aqueous ammonium thiosulfate solution (700 g/L) | 295.0 mL |

-continued

| | (unit: g) |
|---|---|
| Acetic acid (90%) | 3.3 |
| Water to make | 1.0 L |
| pH (adjusted by ammonia water and acetic acid) | 6.7 |
| Stabilizing solution: | |
| p-Nonylphenoxypolyglycidol (average glycidol polymerization degree = 10) | 0.2 |
| Ethylenediaminetetraacetate | 0.05 |
| 1,2,4-triazole | 1.3 |
| 1,4-bis(1,2,4-triazole-1-ylmethyl) piperazine | 0.75 |
| Hydroxyacetic acid | 0.02 |
| Hydroxyethylcellulose (HEC SP-2000 available from DAICEL CHEMICAL INDUSTRIES LTD.) | 0.1 |
| 1,2-benzisothiazoline-3-one | 0.05 |
| Water to make | 1.0 L |
| pH | 8.5 |

After the above development was performed, the ISO of any of these samples 101 to 111 was 420.

[Formation of samples 102 to 111]

Samples 102 to 111 were formed by replacing the high-boiling organic solvents in the 9th to 11th layers of sample 101 as shown in Table 2. The gelatin coating amounts were so controlled that the weight ratios of gelatin to oil components in the individual layers were equal. Table 3 shows the physical values of the high-boiling organic solvents used.

TABLE 2

| Sample No. | High-boiling organic solvent composition ($g/m^2$) 9th layer (Lu) | 10th layer (Lm) | 11th layer (Lo) | Oil phase viscosity $V_2/V_1$ | $V_3/V_1$ | Plastic deformation ratio $\alpha_2/\alpha_1$ | $\alpha_3/\alpha_1$ | Resistance to pressure | Storage stability (40° C. 95%) | Storage stability (60° C. 30%) |
|---|---|---|---|---|---|---|---|---|---|---|
| 101 (Comparative example) | HBS-1 (0.28) HBS-3 (0.01) HBS-4 (0.27) | HBS-1 (0.064) HBS-3 ($2.1 \times 10^{-4}$) | HBS-1 (0.18) HBS-3 ($4 \times 10^{-4}$) | 1.15 | 0.85 | 1.01 | 1.03 | 100 | 100 | 100 |
| 102 (Comparative example) | HBS-1 (0.31) HBS-3 (0.01) | HBS-1 (0.064) HBS-3 ($2.1 \times 10^{-4}$) | HBS-1 (0.18) | 1.15 | 1.06 | 1.01 | 0.99 | 95 | 250 | 22 |
| 103 (Present invention) | HBS-1 (0.18) HBS-3 (0.01) KHB-2 (0.21) | HBS-1 (0.064) HBS-3 ($2.1 \times 10^{-4}$) | HBS-1 (0.18) | 1.15 | 1.40 | 1.01 | 0.98 | 70 | 98 | 21 |
| 104 (Present invention) | HBS-1 (0.18) HBS-3 (0.01) KHB-2 (0.21) | HBS-3 ($2.1 \times 10^{-4}$) KHB-2 (0.11) | KHB-2 (0.30) | 1.18 | 1.06 | 1.04 | 1.02 | 70 | 70 | 19 |
| 105 (Present invention) | HBS-1 (0.09) HBS-3 (0.01) KHB-2 (0.36) | HBS-1 (0.064) HBS-3 ($2.1 \times 10^{-4}$) | HBS-1 (0.18) | 1.15 | 1.62 | 1.01 | 0.97 | 60 | 70 | 20 |
| 106 (Present invention) | HBS-1 (0.09) HBS-3 (0.01) KHB-2 (0.36) | HBS-3 ($2.1 \times 10^{-4}$) KHB-2 (0.11) | HBS-1 (0.18) | 1.66 | 1.62 | 0.94 | 0.97 | 55 | 51 | 18 |
| 107 (Present invention) | HBS-3 (0.01) KHB-2 (0.52) | HBS-3 ($2.1 \times 10^{-4}$) KHB-9 (0.11) | HBS-1 (0.18) | 1.66 | 1.78 | 0.94 | 0.93 | 50 | 48 | 18 |

TABLE 2-continued

| Sample No. | High-boiling organic solvent composition ($g/m^2$) 9th layer (Lu) | 10th layer (Lm) | 11th layer (Lo) | Oil phase viscosity $V_2/V_1$ | $V_3/V_1$ | Plastic deformation ratio $\alpha_2/\alpha_1$ | $\alpha_3/\alpha_1$ | Resistance to pressure | Storage stability (40° C. 95%) | Storage stability (60° C. 30%) |
|---|---|---|---|---|---|---|---|---|---|---|
| 108 (Present invention) | HBS-3 (0.01) KHB-3 (0.52) | HBS-3 ($2.1 \times 10^{-4}$) KHB-9 (0.11) | HBS-1 (0.18) | 1.69 | 1.77 | 0.93 | 0.92 | 49 | 48 | 17 |
| 109 (Present invention) | HBS-3 (0.01) KHB-1 (0.52) | HBS-3 ($2.1 \times 10^{-4}$) KHB-4 (0.11) | HBS-1 (0.18) | 1.65 | 1.79 | 0.92 | 0.93 | 50 | 47 | 18 |
| 110 (Present invention) | HBS-3 (0.01) KHB-6 (0.52) | HBS-3 ($2.1 \times 10^{-4}$) HBS-13 (0.11) | HBS-1 (0.18) | 1.65 | 1.78 | 0.94 | 0.92 | 48 | 46 | 19 |
| 111 (Present invention) | HBS-3 (0.01) KHB-19 (0.52) | HBS-3 ($2.1 \times 10^{-4}$) KHB-27 (0.11) | HBS-1 (0.18) | 1.68 | 1.79 | 0.92 | 0.93 | 51 | 49 | 18 |

TABLE 3

| | Weight-average molecular weight | Viscosity | Dielectric constant | log P |
|---|---|---|---|---|
| HBS-1 | 368.4 | 58 | 7.33 | 5.95 |
| HBS-2 | 278.3 | 20 | 6.45 | 4.65 |
| HBS-4 | 434.6 | 12 | 4.80 | 9.42 |
| KHB-2 | 574.5 | 500 | 7.68 | 7.04 |

The resistance to pressure was evaluated as follows.

Each sample was cut to make a 35 mm×12 cm specimen. An iron bar 3 mm in diameter was horizontally set, and the specimen was hung on this iron bar by folding the specimen in two such that the photographic constituent layers were outside and the back surface was inside. While a load of 500 g was applied on the lower edge of the specimen, the specimen was left to stand for 16 hr at 25° C. and a relative humidity of 55%. This sample was developed, and the magenta density of pressure marks produced in the form of a band was measured. The density difference from a sample developed without performing the above process after coating was calculated as a relative value with respect to sample 101 and used as a representative value indicating the resistance to pressure. The smaller the value, the smaller the pressure marks, and the more favorable the sample.

The storage stability was evaluated as follows.

Each sample was stored under forced deterioration conditions of 40° C. and RH95%, or 60° C. and RH30%, for four days and continuously exposed to white light through a wedge. The sample was developed within 1 hr after the exposure, and the magenta density of the developed sample was measured. A fresh sample not stored under the forced deterioration conditions was similarly developed, and the magenta density of the developed sample was measured. A decrease in the density caused by the forced deterioration conditions with an exposure amount by which the fresh sample had a density of fog +2.0 was calculated as a relative value with respect to sample 101. The smaller the value, the smaller the density decrease, and the more favorable the sample.

It is evident from Table 3 that samples 103 to 111 of the present invention were superior in resistance to pressure and storage stability.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising, on a support, a unit blue-sensitive layer including at least one blue-sensitive silver halide emulsion layer containing a yellow coupler, a unit green-sensitive layer including at least one green-sensitive silver halide emulsion layer containing a magenta coupler, and a unit red-sensitive layer including at least one red-sensitive silver halide emulsion layer containing a cyan coupler, at least one of said unit blue-, green-, and red-sensitive layers comprising not less than two color-sensitive layers differing in sensitivity, of which a highest-sensitivity layer being positioned farthest from said support, wherein said light-sensitive material has at least one layer containing a high-boiling organic solvent, at least 50% by weight of which is occupied by a high-boiling organic solvent having a viscosity of not less than 300 mPas at 25° C., wherein at least one of said unit color-sensitive layers comprises three layers arranged adjacent to each other in the order of a highest-sensitivity layer (Lo), a medium-sensitivity layer (Lm), and a lowest-sensitivity layer (Lu) from the farthest side from said support, and an oil phase viscosity ($v_1$) of Lo, an oil phase viscosity ($v_2$) of Lm, and an oil phase viscosity ($v_3$) of Lu, at 50° C., have the following relationship:

$$v_2>1.5v_1$$

or $$v_3>1.5v_1.$$

2. The material according to claim 1, wherein a plastic deformation ratio ($\alpha_1$) of Lo, a plastic deformation ratio ($\alpha_2$) of Lm, and a plastic deformation ratio ($\alpha_3$) Lu have the following relationship:

$$\alpha_2<0.95\alpha_1$$

or $$\alpha_3<0.95\alpha_1.$$

3. The material according to claim 1, wherein a plastic deformation ratio ($\alpha_1$) of Lo, a plastic deformation ratio ($\alpha_2$) of Lm, and a plastic deformation ratio ($\alpha_3$) of Lu have the following relationship:

$$\alpha_2<0.95\alpha_1$$

or $$\alpha_3<0.95\alpha_1.$$

4. The material according to claim 1, wherein said organic solvent is present in an amount of 0.01 to 3.0 g/m$^2$.

5. The material according to claim 1, wherein the amount of the high-boiling organic solvent having a viscosity of 300 mPas or more is 70 wt % or more of the total high-boiling organic amount in at least one layer.

* * * * *